US010605079B2

(12) United States Patent
Dole et al.

(10) Patent No.: US 10,605,079 B2
(45) Date of Patent: Mar. 31, 2020

(54) FLUID WORKING MACHINE HAVING OFFSET VALVE CYLINDERS

(71) Applicants: Danfoss Power Solutions GmbH & Co. OHG, Neumunster (DE); Artemis Intelligent Power Ltd., Loanhead, Midlothian, Scotland (GB)

(72) Inventors: Alexis Dole, Midlothian (GB); Uwe Bernhard Pascal Stein, Midlothian (GB); Stephen Michael Laird, Midlothian (GB)

(73) Assignees: Danfoss Power Solutions GMBH & Co. OHG, Neumunster (DE); Artemis Intelligent Power Ltd., Loanhead, Midlothian (GB)

( * ) Notice: Subject to any disclaimer, the term of this patent is extended or adjusted under 35 U.S.C. 154(b) by 502 days.

(21) Appl. No.: 14/895,684

(22) PCT Filed: May 27, 2014

(86) PCT No.: PCT/EP2014/060897

§ 371 (c)(1),
(2) Date: Dec. 3, 2015

(87) PCT Pub. No.: WO2014/202345

PCT Pub. Date: Dec. 24, 2014

(65) Prior Publication Data

US 2016/0356160 A1 Dec. 8, 2016

(30) Foreign Application Priority Data

Jun. 18, 2013 (EP) ..... 13172510
Jun. 18, 2013 (EP) ..... 13172511

(51) Int. Cl.
*F01B 1/06* (2006.01)
*F04B 1/0536* (2020.01)
(Continued)

(52) U.S. Cl.
CPC ..... *F01B 1/0624* (2013.01); *F01B 1/062* (2013.01); *F01B 1/0634* (2013.01);
(Continued)

(58) Field of Classification Search
CPC ..... F04B 53/10; F04B 1/0408; F04B 1/0421; F04B 1/047; F04B 39/122; F04B 39/0005;
(Continued)

(56) References Cited

U.S. PATENT DOCUMENTS 2,349,161 A * 5/1944 Frimel ..... F04B 1/0408 417/203
2,435,874 A 2/1948 Davey
(Continued)

FOREIGN PATENT DOCUMENTS

CN 2756861 Y 2/2006
CN 101310108 A 11/2008
(Continued)

OTHER PUBLICATIONS

International Search Report for PCT Serial No. PCT/EP2014/060897 dated Jul. 21, 2014.
(Continued)

*Primary Examiner* — Essama Omgba
*Assistant Examiner* — Stephen A Mick
(74) *Attorney, Agent, or Firm* — McCormick, Paulding & Huber PLLC

(57) ABSTRACT

The invention provides a fluid working machine comprising: a crankshaft (2) which is rotatable about an axis of rotation (3); adjacent first and second groups (5, 6, 8, 10) of valve cylinder devices (13) spaced from each other about the axis of rotation (3), one or each of the first and second groups (5, 6, 8, 10) of valve cylinder devices having first, second and third valve cylinder devices (13) arranged about and extend-
(Continued)

ing outwards with respect to the crankshaft (2), the first and third valve cylinder devices being axially offset from each other, the second valve cylinder device being axially offset from the first and third valve cylinder devices and the second valve cylinder device being offset from the first and third valve cylinder devices about the axis of rotation, wherein the second valve cylinder device has an axial extent which overlaps with the axial extent of one, or the axial extents of both, of the first and third valve cylinder devices.

19 Claims, 7 Drawing Sheets

(51) Int. Cl.

| | |
|---|---|
| ***F04B 1/0408*** | (2020.01) |
| ***F04B 1/0421*** | (2020.01) |
| ***F04B 1/047*** | (2020.01) |
| ***F04B 39/00*** | (2006.01) |
| ***F04B 39/12*** | (2006.01) |
| ***F04B 53/10*** | (2006.01) |

(52) U.S. Cl.
CPC ..... *F01B 1/0655* (2013.01); *F04B 1/047* (2013.01); *F04B 1/0408* (2013.01); *F04B 1/0421* (2013.01); *F04B 1/0536* (2013.01); *F04B 39/0005* (2013.01); *F04B 39/122* (2013.01); *F04B 53/10* (2013.01)

(58) Field of Classification Search
CPC ..... F04B 1/0536; F01B 1/0655; F01B 1/062; F01B 1/0634; F01B 1/0624
See application file for complete search history.

(56) References Cited

U.S. PATENT DOCUMENTS

| | | | | |
|---|---|---|---|---|
| 2,842,060 | A | 7/1958 | Barry | |
| 3,827,338 | A | 8/1974 | Oguni et al. | |
| 4,073,216 | A | 2/1978 | Davis | |
| 5,465,817 | A * | 11/1995 | Muscatell | B60T 1/08 188/290 |
| 6,412,454 | B1 * | 7/2002 | Green | F01B 1/062 123/54.1 |
| 6,446,435 | B1 | 9/2002 | Willmann et al. | |
| 8,944,780 | B2 * | 2/2015 | Reilly | F04B 1/128 417/269 |
| 2007/0098580 | A1 * | 5/2007 | Petersen | F04B 1/0413 417/491 |
| 2010/0092315 | A1 | 4/2010 | Collingborn | |

FOREIGN PATENT DOCUMENTS

| | | | |
|---|---|---|---|
| CN | 102606436 | A | 7/2012 |
| DE | 10 2005 055 057 | A1 | 5/2007 |
| DE | 10 2009 000 580 | A1 | 8/2010 |
| EP | 0 361 927 | A1 | 4/1990 |
| EP | 0 494 236 | A1 | 7/1992 |
| EP | 1 537 333 | | 6/2005 |
| EP | 1 736 666 | A1 | 12/2006 |
| FR | 2 831 221 | A1 | 4/2003 |
| GB | 1 246 811 | | 9/1971 |
| JP | 8232832 | | 9/1996 |
| JP | 2007002848 | A | 1/2007 |
| WO | 91/05163 | A1 | 4/1991 |
| WO | 00/53925 | A1 | 9/2000 |
| WO | 2004/025122 | A1 | 3/2004 |
| WO | 2010/079011 | A1 | 7/2010 |
| WO | 2010/088982 | A1 | 8/2010 |

OTHER PUBLICATIONS

International Search Report for PCT Serial No. PCT/EP2014/060896 dated Jun. 27, 2014.
English Translation of Japanese Office Action for Serial No. 2016-520346 dated Mar. 23, 2018.

* cited by examiner

FLUID WORKING MACHINE HAVING OFFSET VALVE CYLINDERS

CROSS-REFERENCE TO RELATED APPLICATIONS

This application is entitled to the benefit of and incorporates by reference subject matter disclosed in the International Patent Application No. PCT/EP2014/060897 filed on May 27, 2014; European Patent Application No. 13172510 filed Jun. 18, 2013; and European Patent Application No. 13172511 filed Jun. 18, 2013.

TECHNICAL FIELD

The invention relates to: a fluid working machine (e.g. a hydraulic or pneumatic pump, motor or pump/motor); and a method of manufacturing a fluid working machine.

BACKGROUND

Radial piston fluid working machines, such as radial piston pumps, motors or pump/motors, typically comprise a central crankshaft which is rotatable about an axis of rotation and a plurality of piston cylinder devices arranged about and extending radially outwards from the crankshaft. The piston cylinder devices are typically arranged in a plurality of axially offset banks of piston cylinder devices, each bank comprising a plurality of closely packed piston cylinder devices arranged about the axis of rotation and lying on a respective plane extending perpendicularly to the axis of rotation of the crankshaft. The crankshaft comprises at least one cam per bank, and the pistons of each respective bank are arranged in driving relationship with the respective said at least one cam via respective piston feet.

The magnitude of the output (e.g. fluid pressure or mechanical torque) of such radial piston fluid working machines is typically dependent on the number of piston cylinder devices provided in the machine and the capacity of each of the said piston cylinder devices. An increased output magnitude therefore requires an increase in the number of banks and/or an increase in the number of piston cylinder devices per bank and/or an increase in the capacity of the piston cylinder devices used. Increasing the number of banks per machine causes a corresponding increase in the axial length of the machine. The extent to which the number of piston cylinder devices per bank can be increased is dependent on the relative sizes of the piston feet and the cam radius. As the piston cylinder devices are typically closely packed around the axis of rotation of the crankshaft, increasing the number of piston cylinder devices typically requires an increase in the radius of the cams, which correspondingly increases the size of the fluid working machine in a radial direction. Accordingly, an increased output magnitude typically requires an increase in the size of the fluid working machine in radial and/or axial directions.

Fluid working machines of this type are used in hydraulic transmission systems for high power wind turbines. As wind turbine technology develops, higher power turbines are being implemented whose hydraulic transmissions require greater output magnitudes. However, it is desirable to keep the size of the wind turbines as small as possible.

In addition, in order to route fluid from fluid sources, to fluid sinks and to and from working chambers of the piston cylinder devices, complex fluid routing structures can be required, leading to expensive and time consuming manufacturing processes. It is thus also desirable to simplify the way in which fluid is routed around the fluid working machine.

SUMMARY

Accordingly, an object of the invention is to reduce the size of a fluid working machine, typically a radial piston fluid working machine, for a given output magnitude and/or to provide a new fluid working machine which can generate greater magnitude outputs than existing fluid working machines of the same size.

It is also an object of the invention to reduce the cost and to increase the speed of manufacturing a fluid working machine, typically a radial piston fluid working machine.

A first aspect of the invention provides a fluid working machine comprising: a crankshaft which is rotatable about an axis of rotation; adjacent first and second (discrete) groups of valve cylinder devices spaced from each other about the axis of rotation, one or each of the first and second (discrete) groups of valve cylinder devices having first, second and third valve cylinder devices arranged about and extending outwards with respect to the crankshaft, the first and third valve cylinder devices being axially offset from each other, the second valve cylinder device being axially offset from the first and third valve cylinder devices and the second valve cylinder device being (rotationally) offset from the first and third valve cylinder devices about the axis of rotation, wherein the second valve cylinder device has an axial extent which overlaps with the axial extent of one, or the axial extents of both, of the first and third valve cylinder devices.

Typically each of the first and second groups of valve cylinder devices comprises a plurality of valve cylinder devices.

Typically the valve cylinder devices of each of the first and second groups of valve cylinder devices (or the valve cylinder devices of the said one or each of the first and second groups of valve cylinder devices) are arranged together in respective clusters.

By axially offsetting the second valve cylinder device from the first and third valve cylinder devices, offsetting the second valve cylinder device from the first and third valve cylinder devices about the axis of rotation and overlapping the axial extent of the second valve cylinder device with the axial extent of one, or the axial extents of both of the first and third valve cylinder devices, the said one or each of the first and second groups of valve cylinder devices is provided with a space-efficient nested arrangement which allows the length of the fluid working machine (i.e. the dimension parallel to the axis of rotation) to be reduced for a given number of valve cylinder devices in the machine. Preferably, within the said one or each of the first and second groups of valve cylinder devices, the axial extent of the second valve cylinder device overlaps with the axial extents of both the first and third valve cylinder devices. Typically the axial extents of the first and third valve cylinder devices do not overlap with each other.

It may be that the axial overlap of the first and second valve cylinder devices is at least 2.5%, at least 5%, at least 7.5%, at least 10%, at least 15%, at least 20%, at least 25%, at least 30%, at least 40% or at least 50% of the axial extent of the second valve cylinder device. It may be that the axial overlap of the first and second valve cylinder devices is less than 50%, less than 40%, less than 30%, less than 25%, less than 20%, less than 15%, less than 10% or less than 5% of the axial extent of the second valve cylinder device. It may be that the axial overlap of the second and third valve cylinder devices is at least 2.5%, at least 5%, at least 7.5%, at least 10%, at least 15%, at least 20%, at least 25%, at least 30%, at least 40% or at least 50% of the axial extent of the second valve cylinder device. It may be that the axial overlap of the second and third valve cylinder devices is less than 50%, less than 40%, less than 30%, less than 25%, less than 20%, less than 15%, less than 10% or less than 5% of the axial extent of the second valve cylinder device.

By the second valve cylinder device being (rotationally) offset from the first and third valve cylinder devices about the axis of rotation, we typically mean that the plane including the axis of rotation and extending through the centre of the second valve cylinder device is at a different orientation to the plane including the axis of rotation and extending through the centre of the first valve cylinder device and the plane including the axis of rotation and extending through the centre of the third valve cylinder device (if different).

Typically, the second group of valve cylinder devices comprises a valve cylinder device having an axial extent which overlaps the axial extent of a valve cylinder device of the first group of valve cylinder devices. Preferably, the axial extent of the said valve cylinder device of the second group overlaps the axial extent of the said valve cylinder device of the first group is at least 25%, at least 50% (more preferably at least 60%, at least 70%, at least 80%, at least 90% and in some embodiments 100%) of the axial extent of the said valve cylinder device of the second group. It may be that each of the valve cylinder devices in the second group of valve cylinder devices has an axial extent which overlaps the axial extent of a corresponding valve cylinder device of the first group of valve cylinder devices. It may be that the valve cylinder devices of the first group are provided in the same respective planes as corresponding valve cylinder devices of the second group. It may be that at least 25% (preferably at least 50%, at least 60%, at least 70%, at least 80%, at least 90% and in some embodiments 100%) of the axial extents of the valve cylinder devices of the first group overlap the axial extents of corresponding valve cylinder devices of the second group.

It will be understood that by the adjacent first and second groups of valve cylinder devices being "spaced from each other about the axis of rotation", it is meant that the extents of the valve cylinder devices of the first group about the axis of rotation do not overlap with the extents of any of the valve cylinder devices of the second group about the axis of rotation. That is, there is no plane parallel or co-planar with the axis of rotation and passing through a valve cylinder device of the first group which also passes through a valve cylinder device of the second group.

Typically the valve cylinder devices of the first and second groups of valve cylinder devices are arranged to reciprocally receive pistons in driving relationship with the crankshaft (in order to form respective piston cylinder devices). Such pistons may be provided with piston feet in driving relationship with the crankshaft. There is typically a need for the piston feet of pistons reciprocating within the valve cylinder devices to be able to rest against a respective cam of the crankshaft with which they are in driving relationship. By spacing the first and second groups from each other about the axis of rotation, the number of groups of valve cylinder devices which can be arranged around the crankshaft, and thus the number of piston feet resting against the cams of the crankshaft, is reduced (for a given crankshaft). The radial extent of (at least the cams of) the crankshaft can thus be reduced accordingly. In addition, the housing (e.g. (typically monolithic) cylinder block) in which the valve cylinder devices are typically provided can be made mechanically stronger by providing (strengthening) material in the space between the first and second groups about the axis of rotation.

Accordingly, the longitudinal and/or radial extents, and thus the overall size, of the fluid working machine can be reduced by the above arrangement. Alternatively, a greater number of valve cylinder devices can be deployed in a machine of a given size.

It will be understood that, by a first feature being "axially offset" from a second feature, we mean that a vector extending from the first feature to the second feature has a non-zero component parallel to the axis of rotation.

It will be understood that, by a first feature having an axial extent which overlaps with the axial extent of another feature, there is a plane perpendicular to the axis of rotation which extends through both the first and second feature.

Typically the second valve cylinder device of the said one or each of the first and second groups of valve cylinder devices is positioned closer to the first and third valve cylinder devices of that group than to any of the valve cylinder devices of the other of the first and second groups of valve cylinder devices.

By the first and second groups being "adjacent" to each other, it will be understood that no other groups of valve cylinder devices are provided between the first and second groups at least in one rotational sense (e.g. clockwise) about the axis of rotation. Typically, no valve cylinder devices are provided between the first and second groups at least in one rotational sense (e.g. clockwise) about the axis of rotation.

Typically, the second valve cylinder device of the said one or each of the first and second groups is adjacent to the first and third valve cylinder devices of the other of the first and second groups about the axis of rotation (in one rotational sense, e.g. clockwise).

The valve cylinder devices of the first and second groups typically each comprise a (typically hollow) cylinder (for reciprocally receiving a respective piston) and at least one valve unit. The at least one valve unit may be an integrated valve unit comprising a first valve and a second valve (e.g. a low pressure valve and a high pressure valve). Typically the at least one valve unit is coupled to (e.g. screwed into or fastened to) a respective housing bore provided in a housing (e.g. cylinder block) of the fluid working machine. One or more (or preferably all) of the housing bores may be formed by respective voids cast in the housing (e.g. a cylinder block) which are typically subsequently drilled and/or milled. The cylinder may be mounted in the housing bore or, alternatively, the cylinder may be defined by the housing bore (or a combination of these options). Accordingly, it may be that the valve cylinder devices are not discrete components, and they may be formed by coupling (integrating) at least one valve unit to (in) a housing bore cast in a housing (e.g. cylinder block) of the machine. The valve unit(s) may extend outwards from a radially outer end of the cylinder in a direction (substantially) parallel to a longitudinal axis of the housing bore. The valve unit(s) may be a replaceable valve unit(s). The first and/or second (e.g. low and/or high pressure) valves of the integrated valve unit (where provided) may be replaceable.

It will be understood that the terms "low pressure" and "high pressure" are relative terms, the "low pressure" valve typically being connected to a low pressure manifold comprising working fluid and the "high pressure" valve typically being connected to a high pressure manifold comprising working fluid, the working fluid of the high pressure manifold being of a higher pressure than the working fluid of the low pressure manifold.

In some embodiments, within the said one or each of the first and second groups of valve cylinder devices, the extent of the second valve cylinder device (and/or the cylinder of the second valve cylinder device and/or the (e.g. head of the) valve unit of the second valve cylinder device and/or the housing bore in which the second valve cylinder device is provided) about the axis of rotation overlaps with the extent of one, or the extents of both, of the first and third valve cylinder devices (and/or the cylinders of the first and third valve cylinder devices and/or the (e.g. heads of the) valve units of the first and third valve cylinder devices and/or the extents of the housing bores in which the first and third valve cylinder devices are provided) about the axis of rotation. By the extent of the second valve cylinder device (and/or the cylinder of the second valve cylinder device and/or the (e.g. head of the) valve unit of the second valve cylinder device and/or the housing bore in which the second valve cylinder device is provided) about the axis of rotation overlapping with the extent of one, or the extents of both, of the first and third valve cylinder devices (and/or the cylinders of the first and third valve cylinder devices and/or the (e.g. heads of the) valve units of the first and third valve cylinder devices and/or the housing bores in which the first and third valve cylinder devices are provided) about the axis of rotation, it is meant that there is a first plane parallel or co-planar with the axis of rotation and passing through the second valve cylinder device (and/or the cylinder of the second valve cylinder device and/or the (e.g. head of the) valve unit of the second valve cylinder device and/or the housing bore in which the second valve cylinder device is provided) which passes through one of the first and third valve cylinder devices (and/or the cylinder of the said one of the first and third valve cylinder devices and/or the (e.g. heads of the) valve unit of the said one of the first and third valve cylinder devices and/or the housing bore in which the said one of the first and third valve cylinder devices is provided) and, optionally, there is a second plane parallel or co-planar with the axis of rotation and passing through the second valve cylinder device which also passes through the other of the first and third valve cylinder devices (and/or the cylinder of the said other of the first and third valve cylinder devices and/or the (e.g. heads of the) valve unit of the said other of the first and third valve cylinder devices and/or the housing bore in which the said other of the first and third valve cylinder devices is provided) (or a single plane parallel or co-planar with the axis of rotation passes through the first, second and second valve cylinder devices and/or cylinders and/or (e.g. heads of the) valve units and/or housing bores of the group).

Any such overlap about the axis of rotation may be by at least 5%, at least 10%, at least 20%, at least 30%, at least 40%, at least 50%, at least 60% or at least 75% of the extent of the second valve cylinder device (and/or the cylinder of the second valve cylinder device and/or the (e.g. head of the) valve unit of the second valve cylinder device and/or the housing bore in which the second valve cylinder device is provided, as appropriate) about the axis of rotation.

It may be that any such overlap about the axis of rotation is by less than 95%, less than 90%, less than 80%, less than 70%, less than 60%, less than 50%, less than 40%, less than 30%, less than 20%, less than 10% or less than 5% of the extent of the second valve cylinder device (and/or the cylinder of the second valve cylinder device and/or the (e.g. head of the) valve unit of the second valve cylinder device and/or the housing bore in which the second valve cylinder device is provided, as appropriate) about the axis of rotation.

Nevertheless, it may be that, within the said one or each of the first and second groups of valve cylinder devices, the extent of the second valve cylinder device (and/or the cylinder of the second valve cylinder device and/or the (e.g. head of the) valve unit of the second valve cylinder device and/or the housing bore in which the second valve cylinder device is provided) about the axis of rotation does not overlap with the extent of one, or the extents of both, of the first and third valve cylinder devices (and/or the extents of the cylinders of the first and third valve cylinder devices and/or the extent of the (e.g. heads of the) valve units of the first and third valve cylinder devices and/or the extent of the housing bores in which the first and third valve cylinder devices are provided) about the axis of rotation.

In this case, the extent of the spacing about the axis of rotation between the second valve cylinder device (and/or the cylinder of the second valve cylinder device and/or the (e.g. head of the) valve unit of the second valve cylinder device and/or the housing bore in which the second valve cylinder device is provided) and either or both of the first and third valve cylinder devices (and/or the cylinders of the first and third valve cylinder devices and/or the (e.g. heads of the) valve units of the first and third valve cylinder devices and/or the housing bores in which the first and third valve cylinder devices are provided) may be in a range extending from at least 5%, at least 10%, at least 20%, at least 40%, at least 75%, at least 100%, or at least 200% of the extent around the axis of rotation of the second valve cylinder device (and/or the cylinder of the second valve cylinder device and/or the (e.g. head of the) valve unit of the second valve cylinder device and/or the housing bore in which the second valve cylinder device is provided, as appropriate). It may be that said range extends to at most 500%, at most 400%, at most 300%, at most 200%, at most 150%, at most 125% or at most 100% of the extent around the axis of rotation of the second valve cylinder device (and/or the cylinder of the second valve cylinder device and/or the (e.g. head of the) valve unit of the second valve cylinder device and/or the housing bore in which the second valve cylinder device is provided, as appropriate). It may be that no further valve cylinder devices (and/or cylinders of the valve cylinder devices and/or the (e.g. head of the) valve units of valve cylinder devices and/or the housing bores in which the valve cylinder devices are provided) are located within said spacing, within the axial extent of the said one or each of the first and second groups of valve cylinder devices.

The cylinders of the valve cylinder devices typically have a radially inner end comprising an aperture for receiving a piston in driving relationship with the crankshaft.

Typically at least one of the low or high pressure valves comprises a valve member which is engageable with a valve seat. The integrated valve unit is typically an annular valve unit having working fluid ports (typically valve inlets and valve outlets) in the form of annular galleries. The annular galleries may be provided around at least part of the perimeter of the integrated valve unit. Alternatively, the integrated valve units may comprise respective directional working fluid ports. Preferably the valves of the valve cylinder devices are electronically actuatable (i.e. the opening and/or closing of the valves can be electronically controlled). The valves may comprise valve actuators such as hydraulic or electric valve actuators.

Typically, within the said one or each of the first and second groups of valve cylinder devices, the first and third valve cylinder devices are axially aligned with each other (i.e. aligned with each other along an alignment axis (substantially) parallel to the axis of rotation). The alignment axis typically extends between a centre point of the first valve cylinder device and a centre point of the third valve cylinder device in a direction (substantially) parallel to the axis of rotation. The second valve cylinder device is typically offset from the alignment axis about the axis of rotation.

It may be that, within the said one or each of the first and second groups of valve cylinder devices, the cylinder of the second valve cylinder device has an axial extent which overlaps with the axial extent of one, or the axial extents of both, of the cylinders of the first and third valve cylinder devices.

It may be that the axial overlap of the cylinders of the first and second valve cylinder devices is at least 2.5%, at least 5%, at least 7.5%, at least 10%, at least 15%, at least 20%, at least 25%, at least 30%, at least 40% or at least 50% of the axial extent of the cylinder of the second valve cylinder device. It may be that the axial overlap of the cylinders of the first and second valve cylinder devices is less than 50%, less than 40%, less than 30%, less than 25%, less than 20%, less than 15%, less than 10% or less than 5% of the axial extent of the cylinder of the second valve cylinder device. It may be that the axial overlap of the cylinders of the second and third valve cylinder devices is at least 2.5%, at least 5%, at least 7.5%, at least 10%, at least 15%, at least 20%, at least 25%, at least 30%, at least 40% or at least 50% of the axial extent of the cylinder of the second valve cylinder device. It may be that the axial overlap of the cylinders of the second and third valve cylinder devices is less than 50%, less than 40%, less than 30%, less than 25%, less than 20%, less than 15%, less than 10% or less than 5% of the axial extent of the cylinder of the second valve cylinder device.

It may be that, within the said one or each of the first and second groups of valve cylinder devices, (e.g. the head of) the valve unit of the second valve cylinder device has an axial extent which overlaps with the axial extent of (e.g. the head of) the valve unit of one, or the axial extents of (e.g. the heads of) the valve units of both, of the first and third valve cylinder devices.

It may be that the axial overlap of the valve units of the first and second valve cylinder devices is at least 2.5%, at least 5%, at least 7.5%, at least 10%, at least 15%, at least 20%, at least 25%, at least 30%, at least 40% or at least 50% of the axial extent of the valve unit of the second valve cylinder device. It may be that the axial overlap of the valve units of the first and second valve cylinder devices is less than 50%, less than 40%, less than 30%, less than 25%, less than 20%, less than 15%, less than 10% or less than 5% of the axial extent of the valve unit of the second valve cylinder device. It may be that the axial overlap of the valve units of the second and third valve cylinder devices is at least 2.5%, at least 5%, at least 7.5%, at least 10%, at least 15%, at least 20%, at least 25%, at least 30%, at least 40% or at least 50% of the axial extent of the valve unit of the second valve cylinder device. It may be that the axial overlap of the valve units of the second and third valve cylinder devices is less than 50%, less than 40%, less than 30%, less than 25%, less than 20%, less than 15%, less than 10% or less than 5% of the axial extent of the valve unit of the second valve cylinder device.

As indicated above, it may be that the fluid working machine comprises a cylinder block having an axial bore. It may be that the crankshaft extends within the axial bore. It may be that the axial bore is co-axial with the axis of rotation of the crankshaft. It may be that (some or more typically all of) the valve cylinder devices are provided in respective housing bores arranged about and extending (typically radially or substantially radially) outwards with respect to the axial bore. It may be that the first, second and third valve cylinder devices of the said one or each of the first and second groups of valve cylinder devices are provided in respective first, second and third housing bores. It may be that (within the said one or each of the first and second groups of valve cylinder devices) the first and third housing bores are axially offset from each other, the second housing bore is axially offset from the first and third housing bores and the second housing bore is (rotationally) offset from the first and third housing bores about the axis of rotation. It may be that (within the said one or each of the first and second groups of valve cylinder devices) the second housing bore has an axial extent which overlaps with the axial extent of one, or (preferably) the axial extents of both, of the first and third housing bores. Typically (within the said one or each of the first and second groups of valve cylinder devices) the axial extents of the first and third housing bores do not overlap with each other.

It may be that the axial overlap of the first and second housing bores is at least 2.5%, at least 5%, at least 7.5%, at least 10%, at least 15%, at least 20%, at least 25%, at least 30%, at least 40% or at least 50% of the axial extent of the second housing bore. It may be that the axial overlap of the first and second housing bores is less than 50%, less than 40%, less than 30%, less than 25%, less than 20%, less than 15%, less than 10% or less than 5% of the second housing bore. It may be that the axial overlap of the second and third housing bores is at least 2.5%, at least 5%, at least 7.5%, at least 10%, at least 15%, at least 20%, at least 25%, at least 30%, at least 40% or at least 50% of the axial extent of the second housing bore. It may be that the axial overlap of the second and third housing bores is less than 50%, less than 40%, less than 30%, less than 25%, less than 20%, less than 15%, less than 10% or less than 5% of the axial extent of the second housing bore.

By a first feature being "in driving relationship" with a second feature we mean that the first feature is configured to drive and/or be driven by the second feature.

If, in the context of the present application, any statement is made with respect to an overlap and/or to an offset or a spacing (irrespective of whether it is in a radial, an axial or a different direction), in particular if such reference is made using a number (like a percentage), said statement might be dependent on a reference position. For example, for statements about an overlap or an offset/a spacing in the radial direction, such statements are typically dependent on the distance of the respective feature from the central axis (i.e. the radius)). As the "reference position" ("reference plane", "reference height", "reference line", "reference circle" or the like), in particular any one (or more) of the features from the following group might be chosen: the middle of the length of the receiving space for the valve cylinder device and/or any pumping piston, one end (in particular an outer end, typically the end neighbouring the valve cylinder device) of the receiving space for the valve cylinder device and/or any pumping piston, or a percentage along the length of such a receiving space for the valve cylinder device and/or any pumping piston (like 0%, 5%, 10%, 20%, 25%, 30%, 33%, 40%, 50%, 60%, 66%, 70%, 75%, 80%, 90%, 95% or 100%). It is to be understood that according to a typical design of the fluid working machine the respective receiving spaces typically serve for receiving (part of) the pumping pistons and part of the valve cylinder devices. Normally, they are designed as cylindrically shaped bores within the pump's housing. Similarly, any of the aforementioned positions (like 0%, 5% and so on) can be used with respect to the length along an attachment means for the corresponding valve cylinder device (for example a thread within a cylindrical bore). Likewise, any position in the aforementioned sense (like 0%, 5% and so on) along the length of the valve cylinder devices can be used. In particular with respect to a valve cylinder device, it is possible to use additionally or alternatively some additional definitions like the position of a passive valve part, a high-pressure valve part, a low-pressure valve part, a passive valve part, a fluid opening (in particular a fluid inlet conduit and/or a fluid outlet conduit and/or a low-pressure fluid conduit and/or high-pressure fluid conduit). A "fluid opening" is typically an opening that connects a fluid conduit of the valve cylinder device with a fluid conduit of the housing. If a "fluid opening" is used as a reference, not only the "middle cross-sectional position" of the respective opening, but in particular a sideward position of the respective opening (in particular inner and/or outer position with respect to the central axis) can be used as a reference. In case pumping pistons are used, in particular a dead center position, in particular an upper dead center position (presumably with a safety margin) can be used. Nevertheless, any alternative definition that is conceivable by a person, in particular by a person skilled in the art is likewise possible.

The valve cylinder devices of the said first and second groups of valve cylinder devices may extend (substantially) radially outwards with respect to the crankshaft. The axes along which pistons reciprocate in the valve cylinder devices of the first and second groups of valve cylinder devices may extend (substantially) radially outwards with respect to the axis of rotation.

The fluid working machine may further comprise respective pistons reciprocating in the valve cylinder devices of the first and second groups of valve cylinder devices (including the first, second and third valve cylinder devices of the said one or each of the first and second groups of valve cylinder devices).

The crankshaft may comprise a plurality of cams, wherein, within the said one or each of the first and second groups of valve cylinder devices, the pistons reciprocating in the valve cylinder devices are each in driving relationship with a different cam of the said plurality of cams.

Typically, one or more cams of the plurality of cams is(are each) provided in driving relationship with a piston reciprocating in a valve cylinder device of the first group of valve cylinder devices and with a piston reciprocating in a valve cylinder device of the second group of valve cylinder devices.

Typically the crankshaft comprises first, second and third cams.

Within the said one or each of the first and second groups of valve cylinder devices, the piston reciprocating in the first valve cylinder device is typically in driving relationship with the first cam, the piston reciprocating in the second valve cylinder device is typically in driving relationship with the second cam and the piston reciprocating in the third valve cylinder device is typically in driving relationship with the third cam.

Some or (typically) all of the pistons may be arranged such that when they reciprocate in the respective valve cylinder devices they rotate (and rock) about a respective rocking axis (substantially) parallel to the axis of rotation.

Typically, the cams of the crankshaft are axially offset from each other (i.e. in a direction (substantially) parallel to the axis of rotation).

The cylinder of each valve cylinder device typically forms at least part of a respective fluid working chamber. Each working chamber typically has a volume which varies cyclically with reciprocal movement of a respective piston within the cylinder.

A shaft position and speed sensor may be provided which determines the instantaneous angular position and speed of rotation of the shaft, and which transmits shaft position and speed signals to a controller. This enables the controller to determine instantaneous phase of the cycles of each individual working chamber. The controller is typically a microprocessor or microcontroller which executes a stored program in use. The opening and/or the closing of the valves is typically under the active control of the controller.

The controller regulates the opening and/or closing of the first and second (e.g. low and high pressure) valves to determine the displacement of fluid through each working chamber (or through the said one or each of the first and second groups of valve cylinder devices), on a cycle by cycle basis, in phased relationship to cycles of a working chamber volume, to determine the net throughput of fluid through the groups of valve cylinder devices according to a demand (e.g. a demand signal input to the controller). Thus, the fluid working machine typically operates according to the principles disclosed in EP 0 361 927, EP 0 494 236, and EP 1 537 333, the contents of which are incorporated herein by virtue of this reference.

Typically the pistons reciprocating in the valve cylinder devices within the first and/or second of the first and second groups of valve cylinder devices may be controlled (e.g. by the controller controlling hydraulic or pneumatic actuation) fluidly independently of the other pistons of that group. Accordingly, one or two of the pistons may be controlled to work fluidly while the other piston(s) of that group remain idle in any given work cycle.

In one embodiment, the fluid working machine comprises twelve groups of three valve cylinder devices. In another embodiment, the fluid working machine comprises four groups of three valve cylinder devices.

The first, second and third cams are preferably rotationally offset from each other about the axis of rotation such that the pistons reciprocating in the first, second and third valve cylinder devices of the said one or each of the first and second groups of valve cylinder devices drive, or are driven by, the first, second and third cams at phases which are equally or substantially equally spaced. Substantially equally spaced phases may differ from perfectly equally spaced phasing, for example, within ±20°, ±15°, ±10°, ±7.5°, ±5°, ±4°, ±3°, ±2°, or ±1° of perfectly equally spaced phasing.

More generally, the first, second and third cams may be cams of a plurality of cams and the first, second and third valve cylinder devices of the said one or each of the first and second groups of valve cylinder devices may be valve cylinder devices of respective pluralities of valve cylinder devices comprised in the first and second groups, the cams of the plurality of cams being rotationally offset from each other about the axis of rotation such that the pistons reciprocating in the valve cylinder devices of the said one or each of the groups of valve cylinder devices drive, or are driven by the cams at phases which are (substantially) equally spaced.

It may be that (e.g. in the case of a motor or a pump-motor operating in motoring mode), within the said one or each group of valve cylinder devices, the valve cylinder devices receive pressurised fluid pulses (in order to drive the pistons reciprocating in the said respective valve cylinder devices) at phases which are equally spaced or substantially equally spaced. It may be that the cams of the crankshaft are rotationally offset from each other about the axis of rotation such that, within the said one or each group of valve cylinder devices, the pistons reciprocating in the valve cylinder devices of the said one or each group of valve cylinder devices drive the cams at phases which are equally spaced or substantially equally spaced. Additionally or alternatively (e.g. in the case of a pump or a pump-motor operating in pumping mode) it may be that the cams of the crankshaft are rotationally offset from each other about the axis of rotation such that, within the said one or each group of valve cylinder devices, the pistons reciprocating in the valve cylinder devices are driven by the cams at phases which are equally spaced or substantially equally spaced and the valve cylinder devices of the said one or each group provide pressurised fluid pulses at phases which are equally spaced or substantially equally spaced.

The term "phase" relates to where the instantaneous cylinder working volume defined between the pistons and the cylinders of the valve cylinder devices is within a cycle of cylinder working volume. Phase is typically defined (e.g. from zero to 360 degrees or 0 to 2×pi radians) with respect to an arbitrary piston position within a cycle of cylinder working volume (e.g. top dead centre or bottom dead centre).

By equally spacing the phases at which the pistons within the said one or each of the first and second groups of valve cylinder devices drive, or are driven by, the respective cams, it can be ensured that a smooth (substantially constant) output is provided by the said one or each of the first and second groups of valve cylinder devices. By ensuring that the said one or each group provides a smooth output, any such groups that are "ganged" together (i.e. combined at, for example, a suitably shaped end-plate of the fluid working machine) will result in a ganged (combined or communed) output which is also smooth.

It will be understood that there may be, but that there is not necessarily, an equal number of valve cylinder devices in each of the first and second groups of valve cylinder devices. It will be understood that there may be, but that there is not necessarily, the same number of valve cylinder devices in each (or in any group) as the number of cams on the crankshaft.

In one embodiment, the said one or each of the first and second groups of valve cylinder devices consist of (only) first, second and third valve cylinder devices. In this case, the cams of the crankshaft are rotationally offset from each other about the axis of rotation such that the pistons reciprocating in the valve cylinder devices within the said one or each of the first and second groups of valve cylinder devices drive, or are driven by, the cams at phases which are (substantially) 120° out of phase with each other.

The cams may thus be distributed unevenly about the axis of rotation. In this case, the crankshaft may be weighted to account for the uneven distribution of cams about the axis of rotation. Additionally or alternatively, the controller (where provided) may be configured to implement one or more idle cycles of one or more of the piston/valve cylinder device combinations at (typically regular) intervals to reduce the stresses on the crankshaft.

The valve cylinder devices of the said first and second groups of valve cylinder devices typically each comprise a first working fluid port and a second working fluid port wherein, within the first and/or second groups of valve cylinder devices, the first working fluid ports of the valve cylinder devices are fluidly connected and/or the second working fluid ports of the valve cylinder devices are fluidly connected. The first working fluid port of each of the valve cylinder devices of the first and second groups of valve cylinder devices may be an inlet port or an outlet port of a high pressure valve. The second working fluid port of each of the valve cylinder devices of the first and second groups of valve cylinder devices may be an inlet port or an outlet port of a low pressure valve.

Typically the first, second and third valve cylinder devices of the said one or each of the first and second groups of valve cylinder devices each have a first valve comprising a first working fluid port, the respective first working fluid ports of the first valves of the valve cylinder devices within the said one or each of the first and second groups of valve cylinder devices being in fluid communication with each other via a respective (first) common conduit. Typically the (first) common conduit(s) extend within (and typically through) the cylinder block (where provided). Typically a single (first) common conduit is provided to fluidly connect the first working fluid ports of the first valves of the valve cylinder devices within each of the first and second groups of valve cylinder devices.

It may be that, within the said one or each group of valve cylinder devices, the first valves of the valve cylinder devices each comprise a plurality of first working fluid ports, the said first working fluid ports being in fluid communication with the (first) common conduit.

Preferably the cams drive, or are driven by, the pistons reciprocating in the valve cylinder devices of the said one or each of the first and second groups of valve cylinder devices at different phases (which, as discussed above, are preferably at least substantially equally spaced). In this case, the (first) common conduits of each of the said first and second groups of valve cylinder devices can have smaller diameters than might otherwise be the case because they do not need to have capacity for the combined peak flows to or from all of the valve cylinder devices of that group.

The fluid working machine may be a hydraulic or pneumatic (dedicated) pump, (dedicated) motor, or pump-motor which can be operated as a pump and/or a motor (in different operating modes). In the case where the pump-motor is operated as a pump and a motor, most typically the pump-motor operates as a pump in a first cycle and as a motor in a second cycle prior to and/or subsequent to the first cycle. Typically the pump-motor would not operate as a pump and a motor in a single cycle.

The said first valves of the valve cylinder devices within the said one or each of the first and second groups of valve cylinder devices may be low pressure valves or the said first valves of the valve cylinder devices within the said one or each of the first and second groups of valve cylinder devices may be high pressure valves.

The said first valves of the valve cylinder devices within the said one or each of the first and second groups of valve cylinder devices may be inlet valves or the said first valves of the valve cylinder devices within the said one or each of the first and second groups of valve cylinder devices may be outlet valves.

The said first working fluid ports of the first valves of the valve cylinder devices within the said one or each of the first and second groups of valve cylinder devices may be working fluid inlets. In particular, when the first valves of the valve cylinder devices within the said one or each of the first and second groups of valve cylinder devices are inlet valves, the said first working fluid ports of the first valves of the valve cylinder devices within the said one or each of the first and second groups of valve cylinder devices are typically working fluid inlets.

The said first working fluid ports of the first valves of the valve cylinder devices within the said one or each of the first and second groups of valve cylinder devices may be working fluid outlets. In particular, when the first valves of the valve cylinder devices within the said one or each of the first and second groups of valve cylinder devices are outlet valves, the said first working fluid ports of the first valves of the valve cylinder devices within the said one or each of the first and second groups of valve cylinder devices are typically working fluid outlets.

In the case where the fluid working machine is a hydraulic or pneumatic (dedicated) pump or a pump-motor operating in pumping mode, the said first valves of the valve cylinder devices within the said one or each of the first and second groups of valve cylinder devices may be high pressure outlet valves or the said first valves of the valve cylinder devices within the said one or each of the first and second groups of valve cylinder devices may low pressure inlet valves.

In the case where the fluid working machine is a hydraulic or pneumatic (dedicated) motor or a pump-motor operating in motoring mode, the said first valves of the valve cylinder devices within the said one or each of the first and second groups of valve cylinder devices may be low pressure outlet valves or the said first valves of the valve cylinder devices within the said one or each of the first and second groups of valve cylinder devices may be high pressure inlet valves.

In a preferred embodiment, the fluid working machine is a hydraulic or pneumatic pump. In this case, it is preferable that the first valves of the valve cylinder devices within the said one or each of the first and second groups of valve cylinder devices are outlet (high pressure) valves and the respective first working fluid ports of the first valves of the valve cylinder devices within the said one or each of the first and second groups of valve cylinder devices are respective first working fluid outlets, the said respective working fluid outlets of the outlet (high pressure) valves of the valve cylinder devices within the said one or each of the first and second groups of valve cylinder devices being in fluid communication with each other via the respective (first) common conduit extending within the cylinder block.

The valve cylinder devices of the valve cylinder devices within the said one or each of the first and second groups of valve cylinder devices typically comprise second valves comprising respective second working fluid ports. The said respective second working fluid ports of the second valves of the valve cylinder devices within the said one or each of the first and second groups of valve cylinder devices may be in fluid communication with each other via a respective second common conduit. The second common conduit (where provided) typically extends within (e.g. through) the cylinder block (where provided).

It may be that, within the said one or each group of valve cylinder devices, the second valves of the valve cylinder devices each comprise a plurality of second working fluid ports, the said second working fluid ports being in fluid communication with the second common conduit.

The said second valves of the valve cylinder devices within the said one or each of the first and second groups of valve cylinder devices may be inlet valves or the said second valves of the valve cylinder devices within the said one or each of the first and second groups of valve cylinder devices may be outlet valves. In the case where the said first valves of the valve cylinder devices within the said one or each of the first and second groups of valve cylinder devices are inlet valves, typically the second valves of the valve cylinder devices within the said one or each of the first and second groups of valve cylinder devices are outlet valves. In the case where the said first valves of the valve cylinder devices within the said one or each of the first and second groups of valve cylinder devices are outlet valves, typically the second valves of the valve cylinder devices within the said one or each of the first and second groups of valve cylinder devices are inlet valves.

The said second valves of the valve cylinder devices within the said one or each of the first and second groups of valve cylinder devices may be low pressure valves or the said second valves of the valve cylinder devices within the said one or each of the first and second groups of valve cylinder devices may be high pressure valves. In the case where the said first valves of the valve cylinder devices within the said one or each of the first and second groups of valve cylinder devices are low pressure valves, the second valves of the valve cylinder devices within the said one or each of the first and second groups of valve cylinder devices are typically high pressure valves. In the case where the said first valves of the valve cylinder devices within the said one or each of the first and second groups of valve cylinder devices are high pressure valves, the second valves of the valve cylinder devices within the said one or each of the first and second groups of valve cylinder devices are typically low pressure valves.

In the case where the fluid working machine is a hydraulic or pneumatic (dedicated) pump or a pump-motor operating in pumping mode, the said second valves of the valve cylinder devices within the said one or each of the first and second groups of valve cylinder devices may be high pressure outlet valves or the said second valves of the valve cylinder devices within the said one or each of the first and second groups of valve cylinder devices may low pressure inlet valves. In the case where the said first valves of the valve cylinder devices within the said one or each of the first and second groups of valve cylinder devices are high pressure outlet valves, the said second valves of the valve cylinder devices within the said one or each of the first and second groups of valve cylinder devices are typically low pressure inlet valves. In the case where the said first valves of the valve cylinder devices within the said one or each of the first and second groups of valve cylinder devices are low pressure inlet valves, the said second valves of the valve cylinder devices within the said one or each of the first and second groups of valve cylinder devices are typically high pressure outlet valves.

In the case where the fluid working machine is a hydraulic or pneumatic (dedicated) motor or a pump-motor operating in motoring mode, the said second valves of the valve cylinder devices within the said one or each of the first and second groups of valve cylinder devices may be low pressure outlet valves or the said second valves of the valve cylinder devices within the said one or each of the first and second groups of valve cylinder devices may be high pressure inlet valves. In the case where the said first valves of the valve cylinder devices within the said one or each of the first and second groups of valve cylinder devices are low pressure outlet valves, the said second valves of the valve cylinder devices within the said one or each of the first and second groups of valve cylinder devices are typically high pressure inlet valves. In the case where the said first valves of the valve cylinder devices within the said one or each of the first and second groups of valve cylinder devices are high pressure inlet valves, the said second valves of the valve cylinder devices within the said one or each of the first and second groups of valve cylinder devices are typically low pressure outlet valves.

The said second working fluid ports of the second valves of the valve cylinder devices within the said one or each of the first and second groups of valve cylinder devices may be working fluid inlets. In particular, when the second valves of the valve cylinder devices within the said one or each of the first and second groups of valve cylinder devices are inlet valves, the said second working fluid ports of the second valves of the valve cylinder devices within the said one or each of the first and second groups of valve cylinder devices are typically working fluid inlets.

The said second working fluid ports of the second valves of the first and second valve cylinder devices may be working fluid outlets. In particular, when the second valves of the valve cylinder devices within the said one or each of the first and second groups of valve cylinder devices are outlet valves, the said second working fluid ports of the second valves of the valve cylinder devices within the said one or each of the first and second groups of valve cylinder devices are typically working fluid outlets.

In the case where the said first working fluid ports of the first valves of the valve cylinder devices within the said one or each of the first and second groups of valve cylinder devices are working fluid inlets, the said second working fluid ports of the second valves of the valve cylinder devices within the said one or each of the first and second groups of valve cylinder devices are typically working fluid outlets. In the case where the said first working fluid ports of the first valves of the valve cylinder devices within the said one or each of the first and second groups of valve cylinder devices are working fluid outlets, the said second working fluid ports of the second valves of the valve cylinder devices within the said one or each of the first and second groups of valve cylinder devices are typically working fluid inlets.

It may be that, within the said one or each of the first and second groups of valve cylinder devices, the second valve cylinder device is canted with respect to the first and third valve cylinder devices such that the longitudinal axis of the second valve cylinder device (along which the piston reciprocating within the second valve cylinder device reciprocates) intersects with the longitudinal axis of the first and/or third valve cylinder devices (along which the pistons reciprocating within the respective first and/or third valve cylinder devices reciprocate) at the axis of rotation when viewed along the axis of rotation.

However, in some cases, within the said one or each of the first and second groups of valve cylinder devices, the second valve cylinder device may be canted with respect to the first and third valve cylinder devices such that the longitudinal axis of the second valve cylinder device (along which the piston reciprocating within the second valve cylinder device reciprocates) intersects with the longitudinal axis of the first and/or third valve cylinder devices (along which the pistons reciprocating within the respective first and/or third valve cylinder devices reciprocate) above the axis of rotation (i.e. at a point closer to the second and first and/or third valve cylinder devices than the axis of rotation is to the second and first and/or third valve cylinder devices) when viewed along the axis of rotation. This allows more space to be provided circumferentially between the second and first and/or third valve cylinder devices for the (first) common conduit (and/or the second common conduit, where provided) than if the point of intersection was on the axis of rotation.

Preferably the (first) common conduit of the said one or each of the first and second groups of valve cylinder devices has a longitudinal axis (substantially) parallel to the axis of rotation.

As indicated above, the valve cylinder devices may be housed in a cylinder block. Within the said one or each of the first and second groups of valve cylinder devices, the (first) common conduit preferably comprises (or consists of) a single straight drillway extending through (or within) the cylinder block in a direction (substantially) parallel to the axis of rotation. Nevertheless, the said (first) common conduit may be formed by manufacturing technique other than drilling, for example, by casting, milling, spark erosion, laser techniques and/or electron beam techniques which may be used instead of or in addition to drilling.

Within this specification and the appended claims, by substantially parallel we include the possibility of some deviation from parallel, for example, within up to ±1°, ±2°, ±3°, ±4°, ±5°, ±7.5°, ±10°, ±15°, or ±20° of parallel.

Within this specification and the appended claims, by one feature extending "substantially radially" outwards with respect to another feature, we include the possibility of some deviation from radially, for example, within up to ±1°, ±2°, ±3°, ±4°, ±5°, ±7.5°, ±10°, ±15°, or ±20° of radially.

Typically, within the said one or each of the first and second groups of valve cylinder devices, the (first) common conduit of that group extends within (e.g. through) the cylinder block between the respective first working fluid ports of the first valves of the valve cylinder devices.

Within the said one or each of the first and second groups of valve cylinder devices, a or the longitudinal axis of the (first) common conduit is preferably (rotationally) offset from the first and third valve cylinder devices about the axis of rotation in a first rotational sense (e.g. clockwise) and offset from the second valve cylinder device about the axis of rotation in a second rotational sense (e.g. anticlockwise) opposite the first rotational sense such that the (first) common conduit has a circumferential position which is disposed circumferentially between the circumferential position of the second valve cylinder device and the circumferential positions of the first and third valve cylinder devices.

Typically, within the said one or each of the first and second groups of valve cylinder devices, the (first) common conduit extends to a (e.g. inlet or outlet) working fluid port of the machine. The (e.g. inlet or outlet) working fluid port may be provided at an end-plate coupled (e.g. bolted) to an axial face of the cylinder block.

Preferably, within the said one or each of the first and second groups of valve cylinder devices, the (first) common conduit intersects the first working fluid ports of the first valves of the valve cylinder devices. Thus, the (first) common conduit is typically connected directly to the first working fluid ports of the first valves such that the (first) common conduit is in direct fluid communication with the first working fluid ports of the first valves. It will be understood that in this case the (first) common conduit typically intersects the housing bores in which the first, second and third valve cylinder devices are provided.

The second common conduit(s) of the first and/or second (or said one or each) of the first and second groups (where provided) may extend (substantially) parallel to the axis of rotation.

The second common conduit(s) of the first and/or second (or said one or each) of the first and second groups (where provided) may extend in a straight line (substantially) parallel to the axis of rotation.

The second common conduit(s) of the first and/or second (or said one or each) of the first and second groups of valve cylinder devices (where provided) typically extend within (e.g. through) the cylinder block between the respective second working fluid ports of the second valves of the valve cylinder devices of that group of valve cylinder devices.

The second common conduit(s) of the first and/or second (or said one or each) of the first and second groups (where provided) is (are) preferably (each) formed by a single (substantially) straight drillway through (or within) the cylinder block between the respective second working fluid ports of the second valves of the valve cylinder devices of that group of valve cylinder devices. The (or each) single (substantially) straight drillway is preferably (substantially) parallel to the axis of rotation of the crankshaft.

Nevertheless, the said second common conduit may be formed by a manufacturing technique other than drilling, for example, by casting, milling, spark erosion, laser techniques and/or electron beam techniques which may be used instead of or in addition to drilling.

The second common conduit(s) of the first and/or second (or said one or each) of the first and second groups (where provided) may be provided with a longitudinal axis which is offset from the first and third valve cylinder devices of that group about the axis of rotation in a first rotational sense (e.g. clockwise) and offset from the second valve cylinder device of that group about the axis of rotation in a second rotational sense opposite the first rotational sense (e.g. anticlockwise) such that the second common conduit has a circumferential position which is disposed circumferentially between the circumferential position of the second valve cylinder device of that group and the circumferential positions of the first and third valve cylinder devices of that group.

The second common conduit(s) of the first and/or second (or said one or each) of the first and second groups (where provided) typically extend (substantially) parallel to the (first) common conduits of one or (preferably) both of the first and second groups of the valve cylinder devices. Typically the first and second common conduits of the said one or each of the first and second groups of valve cylinder devices extend parallel to each other.

Within each of the said one or each of the first and second groups of valve cylinder devices, the second common conduit typically extends to a (e.g. inlet or outlet) port of the machine (which port may be provided at an end-plate coupled (e.g. bolted) to an axial face of the cylinder block).

Within each of the first and/or second groups of valve cylinder devices (or the said one or each of the first and second groups of valve cylinder device), the second working fluid ports of the second valves of the valve cylinder devices may be connected to a common source of fluid via the second common conduit (where provided), while the first working fluid ports of the first valves of the valve cylinder devices are typically connected to a common sink of fluid via the (first) common conduit.

In some cases, within the first and/or second groups of valve cylinder devices (or the said one or each of the first and second groups of valve cylinder device), the second common conduit (where provided) intersects the respective second working fluid ports of the second valves of the valve cylinder devices. Thus, the second common conduit (where provided) may be connected directly to the respective second working fluid ports of the second valves of the valve cylinder devices such that the second common conduit is in direct fluid communication with the respective second working fluid ports of the second valves of the valve cylinder devices. It will be understood that in this case the second common conduit (where provided) typically intersects the housing bores in which the first, second and third valve cylinder devices of that group are provided.

A plurality, m, of said groups of valve cylinder devices may be provided, each group comprising n valve cylinder devices. Typically adjacent groups are spaced apart from each other about the axis of rotation. In some embodiments, the second valve cylinder device of each of the m groups is offset from the first and third valve devices of that group by an angle of (360/(m*n))° about the axis of rotation. For example, if four groups of three valve cylinder devices are provided, it may be that the second valve cylinder device of the $m^{th}$ group is offset from the first and third valve cylinder devices of that group by (360/(4*3))°=30°. In another example, eight groups of three valve cylinder devices may be provided. In this case, the second valve cylinder device of the $m^{th}$ group is offset from the first and third valve cylinder devices of that group by (360/(8*3))°=15°. If different numbers of valve cylinder devices are provided in each group, it may be that the above equations still apply, but n may be redefined as the number of valve cylinder devices in the group comprising the greatest number of valve cylinder devices of the m groups of valve cylinder devices.

As indicated above, within the said one or each of the first and second groups of valve cylinder devices, the longitudinal axis of the second valve cylinder device is typically offset from the longitudinal axes of one or both of the first and third valve cylinder devices about the axis of rotation. The longitudinal axis of the second valve cylinder device may be offset from the longitudinal axes of one or both of the first and third valve cylinder devices about the axis of rotation by an angle of (360/(m*n))°, where m is the number of groups of valve cylinder devices provided in the cylinder block and n is the number of valve cylinder devices per group (or, as explained above, n may be the number of valve cylinder devices in the group of valve cylinder devices of the m groups of valve cylinder devices having the greatest number of valve cylinder devices).

As also discussed above, the first, second and third cams of the crankshaft may be offset from each other about the axis of rotation. The first and third cams are typically offset from each other by an angle of 2*(360/(n))° in a first rotational sense (e.g. clockwise), where n is the number of valve cylinder devices per group (or, as explained above, n may be the number of valve cylinder devices in the group of valve cylinder devices of the m groups of valve cylinder devices having the greatest number of valve cylinder devices). The second cam may be offset from the first cam about the axis of rotation by an angle of ((360/(n))−α)° in the said first rotational sense where a is the angle in degrees by which the second valve cylinder device is offset from the first and third valve cylinder devices in the said one or each of the first and second groups of valve cylinder devices about the axis of rotation. The second cam is typically offset from the first cam in a or the first rotational sense (e.g. clockwise) about the axis of rotation and offset from the third cam in a second rotational sense (e.g. anticlockwise) opposite the first rotational sense about the axis of rotation such that the second cam has a circumferential position which is circumferentially between the circumferential positions of the first and third cams.

In particular, m (i.e. the number of groups of valve cylinder devices) and/or n (the number of valve cylinder device in a certain group of valve cylinder devices) may be greater than or equal to 3, 4, 5, 6, 7, 8, 9, 10, 11, 12, 13, 14, 15 or 16. It may be that a can lie between 0°, 2.5°, 5°, 7.5°, 10°, 15°, 20°, 25°, 30°, 35°, 40°, 45°, 50°, 60°, 70°, 80°, 90°, 100°, 110° or 120° (lower end) and 10°, 15°, 20°, 25°, 30°, 35°, 40°, 45°, 50°, 60°, 70°, 80°, 90°, 100°, 110°, 120°, 130°, 140°, 150°, 160°, 170°, 175° or 177.5° (upper end).

The fluid working machine may comprise a third group of valve cylinder devices (which is typically adjacent to the first and/or second groups of valve cylinder devices) spaced from the first and second groups of valve cylinder devices about the axis of rotation. The third group of valve cylinder devices may have first, second and third valve cylinder devices arranged about and extending outwards with respect to the crankshaft, the first and third valve cylinder devices being axially offset from each other, the second valve cylinder device being axially offset from the first and third valve cylinder devices and the second valve cylinder device being offset from the first and third valve cylinder devices about the axis of rotation, wherein the second valve cylinder device has an axial extent which overlaps with the axial extent of one, or the axial extents of both, of the first and third valve cylinder devices.

The fluid working machine may comprise a fourth group of valve cylinder devices (which is typically adjacent to one or two of the first, second and third groups of valve cylinder devices) spaced from the first, second and third groups of valve cylinder devices about the axis of rotation. The fourth group of valve cylinder devices may have first, second and third valve cylinder devices arranged about and extending outwards with respect to the crankshaft, the first and third valve cylinder devices being axially offset from each other, the second valve cylinder device being axially offset from the first and third valve cylinder devices and the second valve cylinder device being offset from the first and third valve cylinder devices about the axis of rotation, wherein the second valve cylinder device has an axial extent which overlaps with the axial extent of one, or the axial extents of both, of the first and third valve cylinder devices.

It will be understood that the third and fourth groups of valve cylinder devices (where provided) may have some or all of the optional features of the said one or each of the first and second groups of valve cylinder devices discussed above.

It will be understood that the fluid working machine according to the first aspect of the invention allows for operation in a non-charged or atmospheric state, or a pre-charged or boosted state. In other words, the fluid working machine according to the first aspect of the invention can run pre-charged/boosted and/or not pre-charged/boosted. Whether the machine is pre-charged/boosted or not is dependent upon the application of the system the machine is part of, and the requirements of that system and machine in operation (for example if the machine acts as part of a supplemental pumping system).

A second aspect of the invention provides a method of manufacturing a fluid working machine, the method comprising: providing a crankshaft which is rotatable about an axis of rotation; providing adjacent first and second groups of valve cylinder devices, one or each of the first and second groups of valve cylinder devices having first, second and third valve cylinder devices; and arranging the valve cylinder devices of the first and second groups of valve cylinder devices about the crankshaft such that they extend outwards with respect to the crankshaft, that the adjacent first and second groups of valve cylinder devices are spaced from each other about the axis of rotation and that, within the said one or each of the first and second groups of valve cylinder devices, the first and third valve cylinder devices are axially offset from each other, the second valve cylinder device is axially offset from the first and third valve cylinder devices, the second valve cylinder device is (rotationally) offset from the first and third valve cylinder devices about the axis of rotation, and the second valve cylinder device has an axial extent which overlaps at least partly with axial extent of one, or the axial extents of both, of the first and third valve cylinder devices.

The method may further comprise providing the crankshaft with first, second and third cams. The method may further comprise providing respective pistons reciprocating in the first, second and third valve cylinder devices of the said one or each of the first and second groups of valve cylinder devices. Within the said one or each of the first and second groups of valve cylinder devices, the piston reciprocating in the first valve cylinder device is preferably in driving relationship with the first cam, the piston reciprocating in the second valve cylinder device is preferably in driving relationship with the second cam and the piston reciprocating in the third valve cylinder device is preferably in driving relationship with the third cam, the first, second and third cams being rotationally offset from each other about the axis of rotation such that the pistons reciprocating in the said one or each of the first and second groups of valve cylinder devices drive, or are driven by, the cams at phases which are (substantially) equally spaced.

The method may comprise configuring the fluid working machine such that, within the said one or each group of valve cylinder devices, the valve cylinder devices receive pressurised fluid pulses (in order to drive the pistons reciprocating in the said respective valve cylinder devices) at phases which are equally spaced or substantially equally spaced. It may be that the method further comprises rotationally offsetting the cams of the crankshaft from each other about the axis of rotation such that, within the said one or each group, the pistons reciprocating in the valve cylinder devices drive the cams at phases which are equally spaced or substantially equally spaced. Additionally or alternatively (e.g. in the case of a pump or a pump-motor operating in pumping mode) the method may comprise rotationally offsetting the cams from each other about the axis of rotation such that, within the said one or each group of valve cylinder devices, the pistons reciprocating in the valve cylinder devices are driven by the cams at phases which are equally spaced or substantially equally spaced and the valve cylinder devices of the said one or each group provide pressurised fluid pulses at phases which are equally spaced or substantially equally spaced.

The method may further comprise: providing the first, second and third valve cylinder devices of the said one or each of the first and second groups of valve cylinder devices with respective first valves comprising first working fluid ports; and, within said one or each of the first and second groups of valve cylinder devices, bringing the first working fluid ports of the first valves into fluid communication with each other via a respective (first) common conduit.

It may be that, within the said one or each group of valve cylinder devices, the first valves of the valve cylinder devices each comprise a plurality of first working fluid ports. The method may comprise bringing the said first working fluid ports into fluid communication with the (first) common conduit.

It will be understood that the optional features of the first valves, the first working fluid ports of the first valves and the (first) common conduit outlined above with respect to the first aspect of the invention are also applicable to the second aspect of the invention.

Within the said one or each of the first and second groups of valve cylinder devices, the (first) common conduit preferably has a longitudinal axis (substantially) parallel to the axis of rotation.

As indicated above, the valve cylinder devices may be housed within a (typically monolithic) cylinder block of the fluid working machine. In this case, the method may further comprise, within the said one or each of the first and second groups of valve cylinder devices, forming the (first) common conduit by drilling a single (substantially) straight drillway through (or within) the cylinder block in a direction (substantially) parallel to the axis of rotation.

Typically, within the said one or each of the first and second groups of valve cylinder devices, the (first) common conduit of that group extends within (e.g. through) the cylinder block between the respective working fluid ports of the first valves of the valve cylinder devices.

Within the said one or each of the first and second groups of valve cylinder devices, a or the longitudinal axis of the (first) common conduit is preferably (rotationally) offset from the first and third valve cylinder devices about the axis of rotation in a first rotational sense (e.g. clockwise) and offset from the second valve cylinder device about the axis of rotation in a second rotational sense (e.g. anticlockwise) opposite the first rotational sense such that the (first) common conduit has a circumferential position which is disposed circumferentially between the circumferential position of the second valve cylinder device and the circumferential positions of the first and third valve cylinder devices.

Preferably, within the said one or each of the first and second groups, the method comprises intersecting the respective first working fluid ports of the first valves of the valve cylinder devices with the (first) common conduit. Thus, the (first) common conduit is typically connected directly to the respective first working fluid ports of the first valves of the valve cylinder devices such that the (first) common conduit is in direct fluid communication with the respective first working fluid ports of the first valves of the valve cylinder devices.

The method may further comprise forming (e.g. casting and/or drilling) housing bores in the cylinder block in which the valve cylinder devices are provided.

The method may further comprise installing the first, second and third valve cylinder devices of the said one or each group in respective housing bores.

Within the said one or each of the first and second groups, the method may comprise intersecting the housing bores in which the first, second and third valve cylinder devices of that group are provided with the (first) common conduit of that group (typically such that the (first) common conduit can intersect the respective first working fluid ports of the first valves of the valve cylinder devices of the first valves of the valve cylinder devices of that group).

Typically the method further comprises, within the said one or each of the first and second groups of valve cylinder devices, extending the (first) common conduit to a (e.g. inlet or outlet) port of the machine (which is typically different from the working fluid ports of the valves of the valve cylinder devices). The said (e.g. inlet or outlet) port of the machine may be provided at an end-plate coupled (e.g. bolted) to an axial face of the cylinder block. The method may further comprise coupling (e.g. bolting) an end-plate to an axial face of the cylinder block, the end-plate comprising one or more working fluid ports with which the or a respective (first) common conduits are in fluid communication.

Within the first and second groups of valve cylinder devices, the valve cylinder devices typically each have second valve comprising a second working fluid port. The respective second working fluid ports of the second valves of the valve cylinder devices within the first and/or second (or the said one or each of the first and second) groups of valve cylinder devices may be in fluid communication with each other via a respective second common conduit (which typically extends within the cylinder block). Accordingly the method may comprise forming the second common conduit (typically extending within the cylinder block, where provided) such that the second common conduit brings the respective second working fluid ports of the second valves of the valve cylinder devices within the first and/or second (or the said one or each of the first and second) groups of valve cylinder devices into fluid communication with each other.

It may be that, within the said one or each group of valve cylinder devices, the second valves of the valve cylinder devices each comprise a plurality of second working fluid ports. The method may comprise bringing the said second working fluid ports into fluid communication with the second common conduit.

It will be understood that the optional features of the second valves, the second working fluid ports of the second valves and the second common conduit outlined above with respect to the first aspect of the invention are also applicable to the second aspect of the invention.

The method may comprise forming the second common conduit(s) of the first and/or second (or said one or each) of the first and second groups (where provided) such that it extends (substantially) parallel to the axis of rotation.

The method may comprise forming the second common conduit(s) of the first and/or second (or said or each) of the first and second groups (where provided) such that it extends (substantially) in a straight line (substantially) parallel to the axis of rotation.

Within the first and/or second (or said one or each) of the first and second groups of valve cylinder devices, the method may comprise forming the second common conduit (where provided) such that it extends within (e.g. through) the cylinder block between the respective second working fluid ports of the second valves of the valve cylinder devices.

The method may comprise forming the (each) second common conduit(s) of the first and/or second (or the said one or each) of the first and second groups (where provided) by forming a (single) straight drillway through (or within) the cylinder block. Preferably (within the said groups) the (single) straight drillway of the second common conduit extends between the respective second working fluid ports of the second valves of the valve cylinder devices.

Preferably, within the said one or each of the first and second groups, the method comprises intersecting the respective second working fluid ports of the second valves of the valve cylinder devices with the respective second common conduit of that group. Thus, the second common conduit is typically connected directly to the respective second working fluid ports of the second valves of the valve cylinder devices of that group such that the second common conduit of that group is in direct fluid communication with the respective second working fluid ports of the second valves of the valve cylinder devices of that group.

The method may further comprise forming (e.g. casting and/or drilling) housing bores in the cylinder block in which the valve cylinder devices can be provided. Within the said one or each of the first and second groups, the method may comprise intersecting the housing bores in which the first, second and third valve cylinder devices of that group are provided with the second common conduit (typically such that the second common conduit can intersect the respective second working fluid ports of the second valves of the valve cylinder devices of that group).

The second common conduit(s) of the first and/or second (or the said one or each) of the first and second groups (where provided) may have a longitudinal axis which is (rotationally) offset from the first and third valve cylinder devices of that group about the axis of rotation in a first rotational sense (e.g. clockwise) and offset from the second valve cylinder device of that group about the axis of rotation in a second rotational sense opposite the first rotational sense (e.g. anticlockwise) such that the second common conduit has a circumferential position which is disposed circumferentially between the circumferential position of the second valve cylinder device of that group and the circumferential positions of the first and third valve cylinder devices of that group.

The second common conduit(s) of the first and/or second (or said one or each of the first and second) groups of valve cylinder devices (where provided) typically extend (substantially) parallel to the (first) common conduit of the said one or each of the first and second groups of valve cylinder devices.

The method may further comprise extending the second common conduit(s) of the first and/or second (or the said one or each of the first and second) groups of valve cylinder devices to one or more (e.g. inlet or outlet) ports of the machine (which port(s) may be provided at an end-plate coupled (e.g. bolted) to an axial face of the cylinder block).

Within the first and/or second groups of valve cylinder devices (or said one or each) of the first and second groups of valve cylinder devices, the respective second working fluid ports of the second valves of the valve cylinder devices may be connected to a common source of fluid via the second common conduit, while the respective first working fluid ports of the valve cylinder devices of that group are typically connected to a common sink of fluid via the (first) common conduit of that group.

A third aspect of the invention provides a fluid working machine comprising: a cylinder block comprising an axial bore; a crankshaft which extends within the axial bore and is rotatable about an axis of rotation; first and second valve cylinder devices provided in respective first and second housing bores of the cylinder block, the said housing bores being arranged about and extending outwards with respect to the axial bore, wherein the first and second housing bores are axially offset from each other, wherein the first and second housing bores are offset from each other about the axis of rotation, and wherein the first housing bore has an axial extent which overlaps with the axial extent of the second housing bore.

The invention also extends in a fourth aspect of the invention to a fluid working machine comprising: a cylinder block comprising an axial bore; a crankshaft which extends within the axial bore and is rotatable about an axis of rotation; adjacent first and second groups of valve cylinder devices spaced from each other about the axis of rotation, one or each of the first and second groups of valve cylinder devices having first, second and third valve cylinder devices provided in respective first, second and third housing bores of the cylinder block, the said housing bores being arranged about and extending outwards with respect to the axial bore, wherein, within the said one or each of the first and second groups of valve cylinder devices, the first and third housing bores are axially offset from each other, the second housing bore is axially offset from the first and third housing bores, and the second housing bore is (rotationally) offset from the first and third housing bores about the axis of rotation, the second housing bore having an axial extent which overlaps with the axial extent of one, or the axial extents of both, of the first and third housing bores.

Further optional features of the fluid working machine of the fourth aspect of the invention, and features such as the valve cylinder devices, the first and second group of valve cylinder devices and so forth correspond to those described above in relation to the first three aspects. The axial extent of, and the extent of axial overlap and axial offset of the said housing bores corresponds to that described above in relation to valve cylinder devices.

In respect of at least the first, second and fourth aspects of the invention, preferably each of the first and second groups of valve cylinder devices have the features attributed to "one or each of the first and second groups of valve cylinder devices".

It will be understood that optional and mandatory features of each aspect of the invention is an optional aspect of each of the other aspects of the invention, where appropriate. For the avoidance of doubt, the optional and mandatory features of the first aspect of the invention are optional features of the second, third and fourth aspects of the invention where applicable.

BRIEF DESCRIPTION OF THE DRAWINGS

An example embodiment of the present invention will now be illustrated with reference to the following Figures in which.

DETAILED DESCRIPTION

Figure 1B:
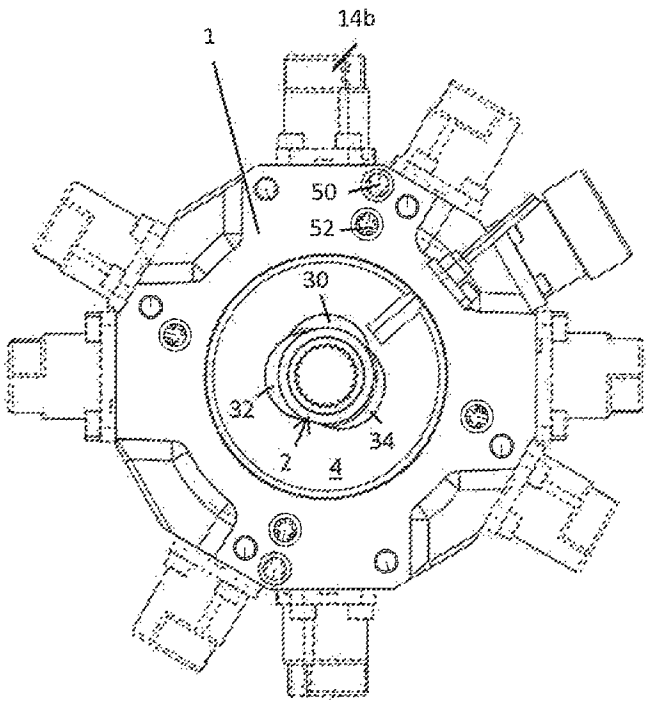
FIGS. 1*a* and 1*b* are exploded perspective and frontal views a cylinder block and a crankshaft of a fluid working machine.
Figure 1A:
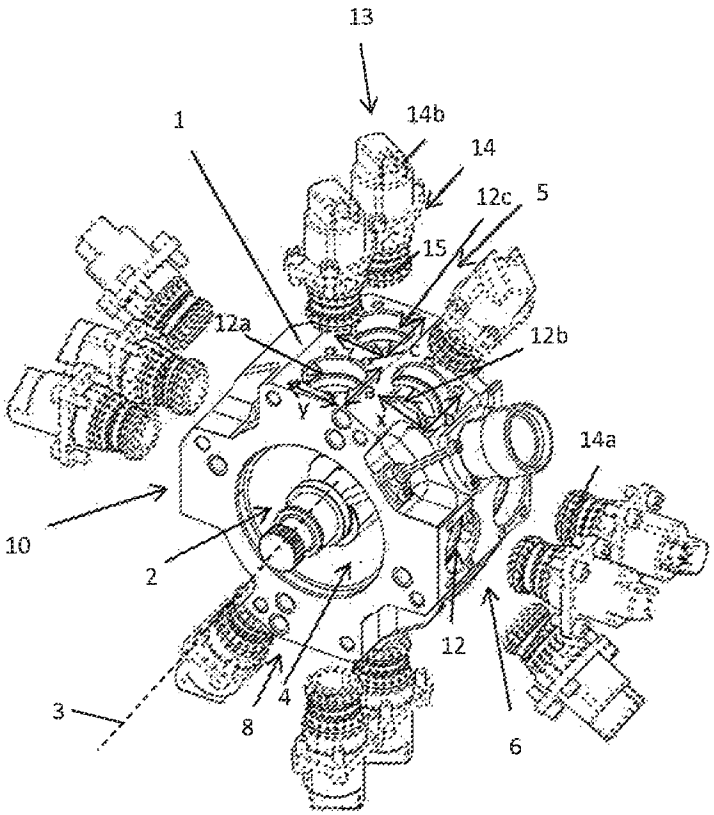
Figure 2B:
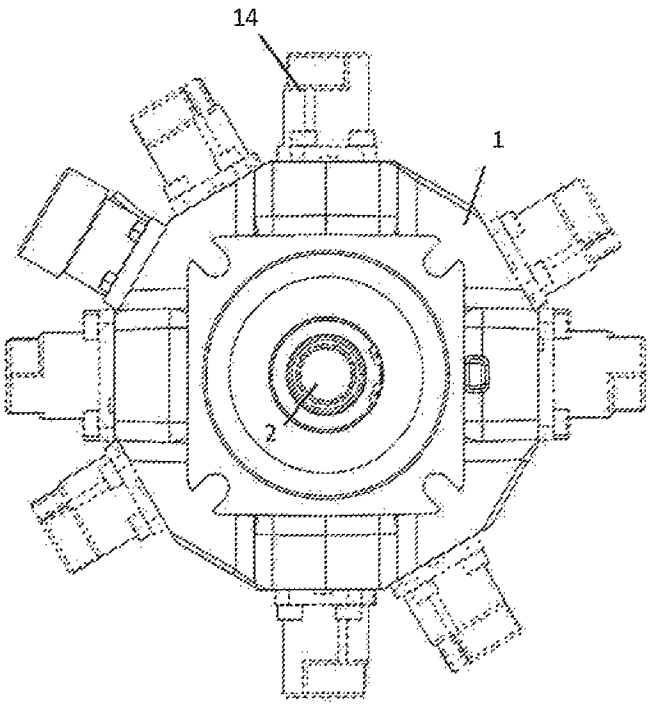
FIGS. 2*a* and 2*b* are exploded perspective and rear views the cylinder block and crankshaft shown in FIGS. 1*a* and 1 *b;*
Figure 2A:
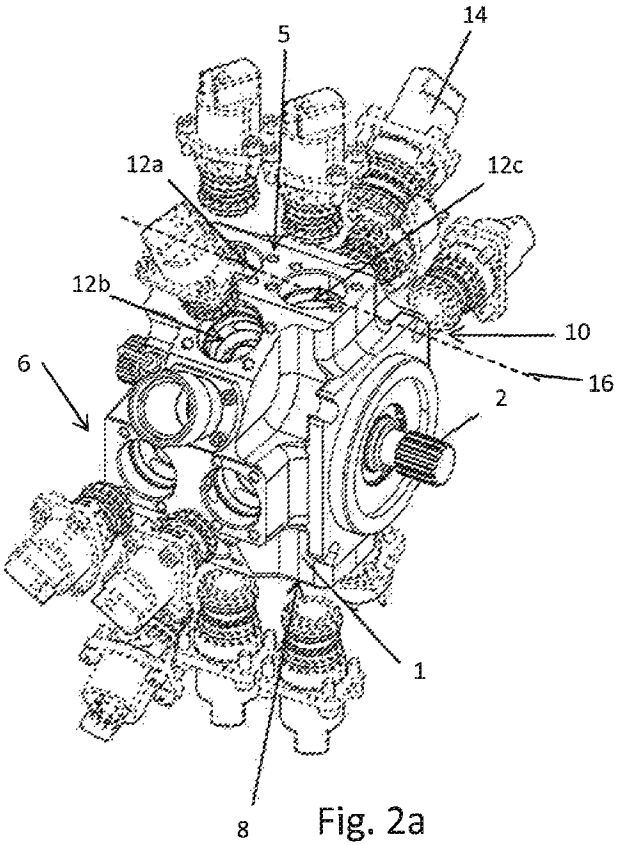

FIGS. 1*a* and 1*b* are exploded front perspective and frontal views respectively of a (typically monolithic) cylinder block 1 and rotatable crankshaft 2 of a radial piston fluid working machine, which may be (for example) a hydraulic or pneumatic pump, motor or pump/motor (which is capable of operating as a pump and/or as a motor in different operating modes). FIGS. 2*a*, 2*b* are rear perspective and rear views respectively of the cylinder block 1 and crankshaft 2.

Figure 3B:
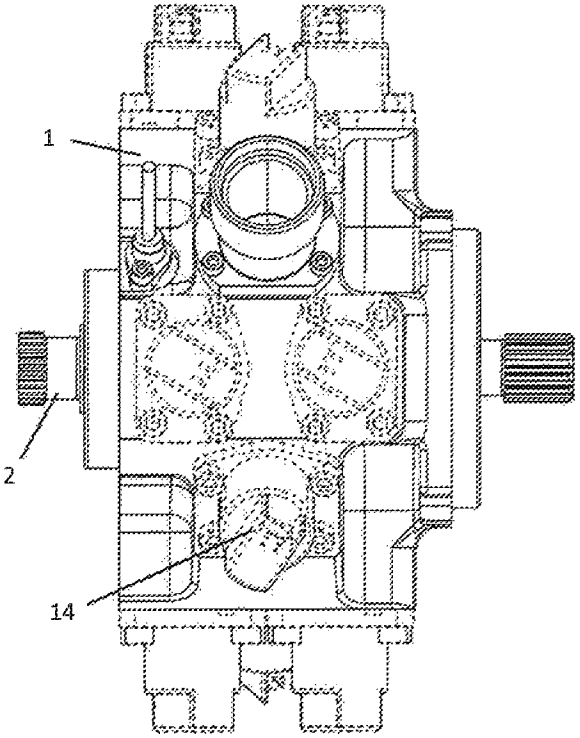
FIGS. 3*a* and 3*b* are side views of the cylinder block and crankshaft of FIGS. 1*a*, 1*b*, 2*a* and 2*b;*
Figure 3A:
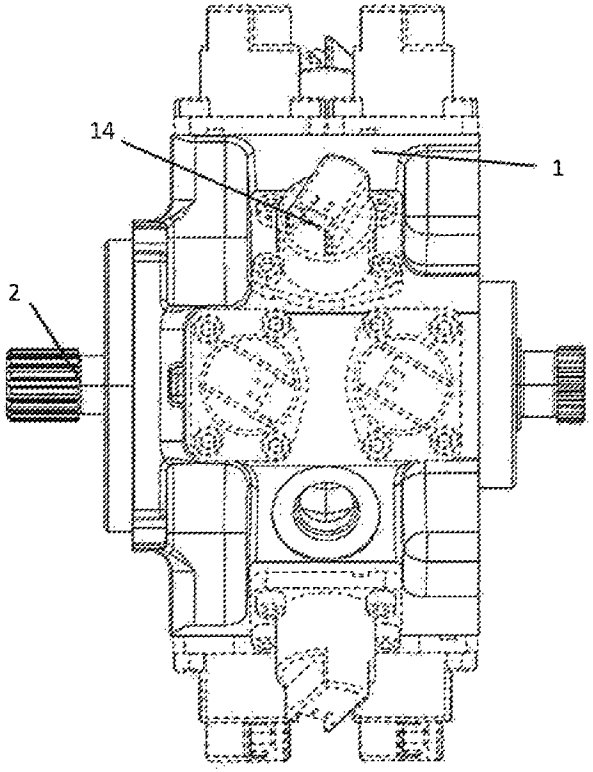

FIGS. 3*a*, 3*b* are respective side views of the cylinder block 1 and crankshaft 2. The crankshaft is rotatable about an axis of rotation 3 (see FIG. 1*a*), and is provided in a central axial bore 4 extending through the cylinder block 1 in a direction parallel to the axis of rotation 3. The cylinder block 1 comprises four groups 5-10 of housing bores (formed by drilling drillways through the cylinder block 1 or by casting holes in the cylinder block 1 which are typically subsequently drilled) 12 sized and arranged to receive (and/or to help to define) respective valve cylinder devices 13, each of the valve cylinder devices comprising an integrated valve unit 14 in fluid communication with (and coupled to) a cylinder 15. It will be understood that the cylinders 15 may be omitted, and the housing bores 12 may alternatively define the cylinders of the valve cylinder devices 13.

The housing bores 12 are disposed about the crankshaft 2 and extend (typically radially) outwards with respect to the crankshaft 2. The groups 5-10 of housing bores 12 are spaced from adjacent groups of housing bores about the axis of rotation 3. In the illustrated embodiment, the groups 5-10 of housing bores 12 are substantially identical. It will therefore be understood that the features of the first group 5 are also (in the illustrated embodiment) features of the other groups 6-10. Indeed, the valve cylinder devices of the first group are typically provided on the same planes as the corresponding valve cylinder devices of the other groups 6-10 (i.e. corresponding valve cylinder devices between groups have axial extents which (typically fully) overlap). Accordingly, only the first group 5 is described in detail below. However, in other embodiments there may be variations between groups, such as the number of housing bores (and thus the numbers of valve cylinder devices) per group and the configurations of the common conduits (see below).

The first group 5 of housing bores 12 comprises first, second and third housing bores 12*a*, 12*b*, 12*c*. The first and third housing bores 12*a*, 12*c* are axially displaced from each other in a direction parallel to the axis of rotation 3, and aligned with each other along an alignment axis 16 (see FIG. 2*a*) which extends between the centres of the first and third housing bores 12*a*, 12*c* in a direction parallel to the axis of rotation 3. The second housing bore 12*b* is axially offset from the first and third housing bores 12*a*, 12*c*, and the second housing bore 12*b* is also offset from the first and third housing bores 12*a*, 12*c* in a clockwise direction as viewed in FIG. 1*a* about the axis of rotation 3 by an angle of approximately 30° (measured from the alignment axis to the centre of the second housing bore 12*b* about the axis of rotation 3). The second housing bore 12*b* has an axial extent, b, which overlaps with the axial extents a and c of the first and third housing bores 12*a*, 12*c* (see FIG. 1*a*), while the axial extents of the first and third housing bores 12*a*, 12*c* do not typically overlap. By axially offsetting the second housing bore 12*b* from the first and third housing bores 12*a*, 12*c*, offsetting the second housing bore 12*b* from the first and third housing bores 12*a*, 12*c* about the axis of rotation 3 and overlapping the axial extent b of the second housing bore 12*b* with the axial extents a, c of the first and third housing bores 12*a*, 12*c*, the group 5 of housing bores is provided with a space efficient nested arrangement. This allows a greater number of housing bores 12 (and thus valve cylinder devices) to be incorporated into a cylinder block 1 of a given axial length (i.e. a given length in a direction parallel to the axis of rotation). The second housing bore 12*b* also has an extent, x, about the axis of rotation which does not in this case overlap with the extents, y, z of the first and third housing bores 12*a*, 12*c* about the axis of rotation (although in other embodiments the extent, x, of the second housing bore 12*b* may overlap with the extents y, z of the first and/or third housing bores 12*a*, 12*c* about the axis of rotation).

It will be understood that, within each of the groups 5-10, the valve cylinder devices 13 provided in the housing bores 12*a*, 12*c* are axially aligned and axially offset from each other and that the valve cylinder device 13 provided in housing bore 12*b* is axially offset from the valve cylinder devices 13 provided in the housing bores 12*a*, 12*c* and the valve cylinder device 13 provided in housing bore 12*b* is offset from the valve cylinder devices 13 provided in the housing bores 12*a*, 12*c* about the axis of rotation. The axial extent of the valve cylinder device 13 provided in housing bore 12*b* overlaps the axial extents of the valve cylinder devices 13 provided in the housing bores 12*a*, 12*c*, while the axial extents of the valve cylinder devices 13 provided in the housing bores 12*a*, 12*c* do not typically overlap. Indeed, typically, the cylinders 15 (where provided) of the valve cylinder devices 13 provided in the housing bores 12*a*, 12*c* are axially aligned and axially offset from each other, the cylinder 15 (where provided) of the valve cylinder device 13 provided in housing bore 12*b* is axially offset from the cylinders 15 of the valve cylinder devices 13 provided in the housing bores 12*a*, 12*c*, and the cylinder 15 of the valve cylinder device 13 provided in housing bore 12*b* is offset from the cylinders 15 of the valve cylinder devices 13 provided in the housing bores 12*a*, 12*c* about the axis of rotation 3. The axial extent of the cylinder 15 of the valve cylinder device 13 provided in housing bore 12*b* typically overlaps the axial extents of the cylinders 15 of the valve cylinder devices 13 provided in the housing bores 12*a*, 12*c*, while the axial extents of the cylinders 15 of the valve cylinder devices 13 provided in the housing bores 12*a*, 12*c* do not typically overlap.

Integrated valve units 14 of the valve cylinder devices 13 comprise both low and high pressure valves. It will be understood that for pumps (or pump/motors operating in pumping mode), the low pressure valve acts as an inlet valve and the high pressure valve as an outlet valve; for motors (or pump/motors operating in motoring mode), the high pressure valve acts as an inlet valve and the low pressure valve as an outlet valve. The valve units 14 typically comprise a threaded end 14*a* which can be screwed into corresponding threads provided in radially outer (with respect to the axis of rotation 3) ends of the housing bores 12 to retain the valve units 14 in the housing bores 12. Additionally or alternatively threads may be provided on the outer diameters of the cylinders 15 (where provided) which instead mate with the threads of the housing bores 12.

The valve units 14 also each comprise a valve head 14*b* provided at a second end of the valve unit 14 opposite the threaded end 14*a* at a radially outer (with respect to the crankshaft) end of the valve cylinder devices 13. The heads 14*b* of the valve units 14 of the valve cylinder devices 13 provided in the housing bores 12*a*, 12*c* are axially aligned and axially offset from each other, the head 14*b* of the valve unit 14 of the valve cylinder device 13 provided in the housing bore 12*b* is axially offset from the heads of the valve units 14 of the valve cylinder devices 13 provided in the housing bores 12*a*, 12*c*, and the head 14*b* of the valve unit 14 of the valve cylinder device 13 provided in housing bore 12*b* is offset from the heads of the valve units 14 of the valve cylinder devices 13 provided in the housing bores 12*a*, 12*c* about the axis of rotation 3. The axial extent of the head 14*b* of the valve unit 14 of the valve cylinder device 13 provided in housing bore 12*b* typically overlaps the axial extents of the heads 14*b* of the valve units 14 of the valve cylinder devices 13 provided in the housing bores 12*a*, 12*c*, while the axial extents of the heads 14*b* of the valve units 14 of the valve cylinder devices 13 provided in housing bores 12*a*, 12*c* do not typically overlap.

Figure 4:
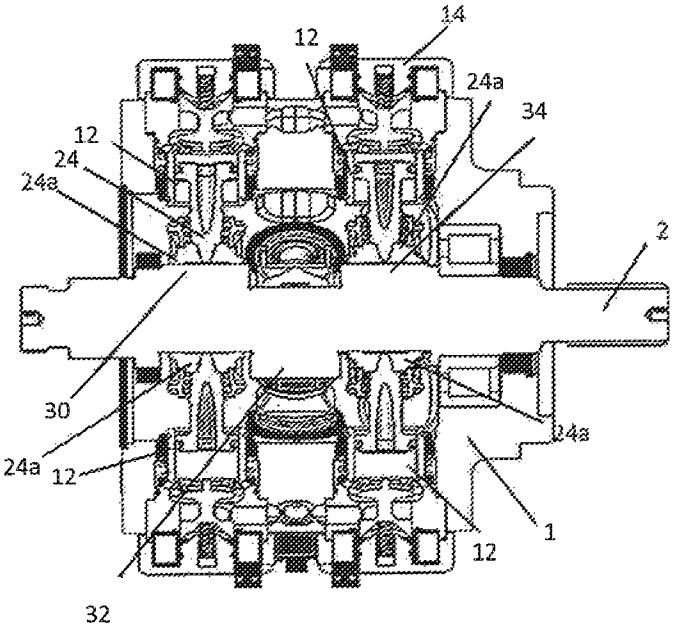
FIG. 4 is a side sectional view of the cylinder block and crankshaft of FIGS. 1-3.
Figure 5B:
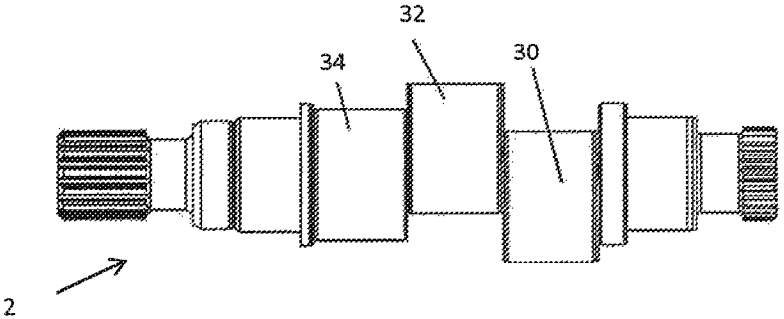
FIGS. 5*a*-5*d* are frontal, perspective and respective side views of the crankshaft of FIGS. 1-4, FIGS. 5*c* and 5*d* showing the crankshaft at different stages of rotation.
Figure 5D:
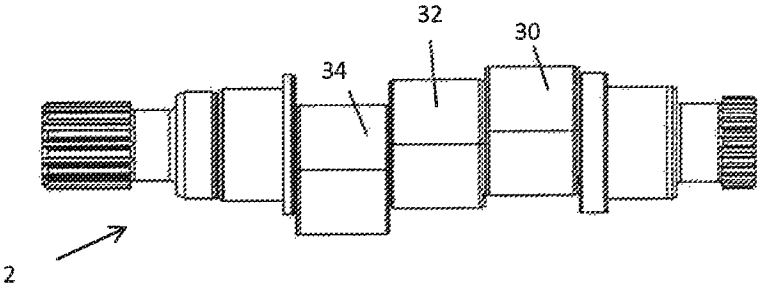
Figure 5A:
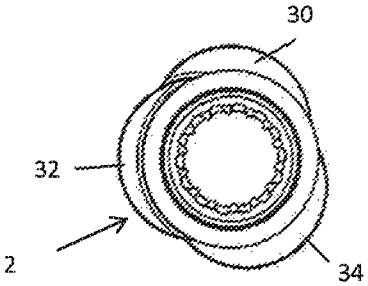
Figure 5C:
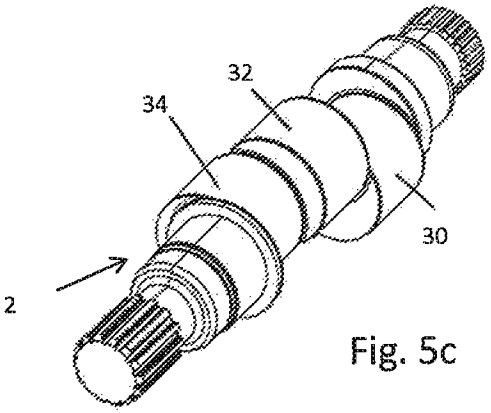

As shown in FIG. 4, radially inner (with respect to the axis of rotation 3) ends of the cylinders 15 (or of the housing bores 12) comprise apertures which reciprocably receive pistons 24 in driving relationship with the crankshaft 2. The crankshaft 2 comprises first, second and third cams 30-34 (which in the illustrated embodiment are eccentrics) which are axially displaced from each other. The pistons 24 each comprise piston feet 24*a* resting on (and in driving relationship with) a respective cam 30-34 of the crankshaft 2. More specifically, via respective piston feet 24*a*, the first cam 30 is in driving relationship with the piston 24 reciprocating in the valve cylinder device 13 provided in the first housing bore 12*a* (of each of the groups 5-10); the second cam 32 is in driving relationship with the piston 24 reciprocating in the valve cylinder device 13 provided in the second housing bore 12*b* (of each of the groups 5-10); and the third cam 34 is in driving relationship with the piston 24 reciprocating in the valve cylinder device 13 provided in the third housing bore 12*c* (of each of the groups 5-10). The said pistons 24 cyclically reciprocate within a respective cylinder 15 (or housing bore 12) substantially in a radial direction with respect to the axis of rotation 3, thereby cyclically varying the volume of respective working chambers defined between the respective piston 24 and the cylinder 15 (or housing bore 12) in which it reciprocates. The pistons 24 are arranged such that when they drive, or are driven by, the respective cams 30-34 of the crankshaft 2, they rotate (and rock) about respective rocking axes parallel to the axis of rotation.

The integrated valve unit 14 comprises a valve member which is engageable with a valve seat. The integrated valve unit 14 is typically an annular valve unit having valve inlets and valve outlets in the form of annular galleries provided in the perimeter of the annular valve unit 14 (see FIGS. 7*a*-7*c* described below). One or both of the low and high pressure valves of the integrated valve unit 14 are electronically actuatable (i.e. the opening and/or closing of the valves can be electronically controlled). A position and speed sensor may be provided which determines the instantaneous angular position and speed of rotation of the crankshaft 2, and which transmits shaft position and speed signals to a controller (not shown). This enables the controller to determine instantaneous phase of the cycles of each individual working chamber. The opening and/or the closing of the valves is typically under the active control of the controller. The controller thus regulates the opening and/or closing of the low and high pressure valves to determine the displacement of fluid through each working chamber (or through each group of working chambers), on a cycle by cycle basis, in phased relationship to cycles of working chamber volume, to determine the net throughput of fluid through each of the groups 5-10 according to a demand (e.g. a demand signal input to the controller). Thus, the fluid working machine typically operates according to the principles disclosed in EP 0 361 927, EP 0 494 236, and EP 1 537 333, the contents of which are incorporated herein by virtue of this reference.

By spacing the groups 5-10 from each other about the axis of rotation 3, the radial extent of the crankshaft 2 can be reduced (compared to closely packing the groups around the crankshaft 2). This is explained as follows. There is a need for the piston feet 24*a* to be able to rest against the respective cam with which they are in driving relationship. Spacing the groups 5-10 from each other about the crankshaft 2 reduces the number of piston cylinder devices which can be provided around the crankshaft 2 and, because fewer piston feet need to rest on each cam 30-34, the surface areas of the cams 30-34 do not need to be as large and the radial extents of cams 30-34 can be reduced accordingly. In addition, the cylinder block 1 can be made mechanically stronger than a cylinder block in which the housing bores 12 are more closely packed because (strengthening) material is provided in the space between the groups about the axis of rotation 3.

The first, second and third cams 30-34 are offset from each other about the axis of rotation 3 of the crankshaft 2 and they drive (in the case of a pump or a pump/motor operating in pumping mode) or are driven by (in the case of a motor or a pump/motor operating in motoring mode) the pistons reciprocating in the housing bores 12*a*, 12*b*, 12*c*. The second housing bore 12*b* of each group is offset from the first and third housing bores 12*a*, 12*c* of that group about the axis of rotation, and thus in order to provide a smooth output the cams 30-34 are not equally distributed (0°,120°, 240°) about the axis of rotation. Rather, the second cam 32 in driving relationship with the second (offset) valve cylinder device 12*b* is also offset from a position equally spaced with respect to the first and third cams 30, 34 in order to provide the machine with groups of piston cylinder devices which work together driving or being driven at phases which are (substantially) equally spaced. For example, if the second housing bore 12*b* is offset from the alignment axis 16 of the first and third housing bores 12*a*, 12*c* by 30°, the second cam 32 may be offset from the first cam 30 by 90° about the axis of rotation in a first rotational sense (e.g. clockwise), the third cam 34 may be offset from the first cam 30 by 240° about the axis of rotation in the said first rotational sense, and the third cam 34 may be offset from the second cam 32 by 150° about the axis of rotation in the said first rotational sense. This enables the first, second and third cams 30-34 to drive or be driven by the pistons reciprocating in the housing bores 12*a*-12*c* at phases which are successively 120° apart (i.e. at phases which are equally spaced).

Figure 6:
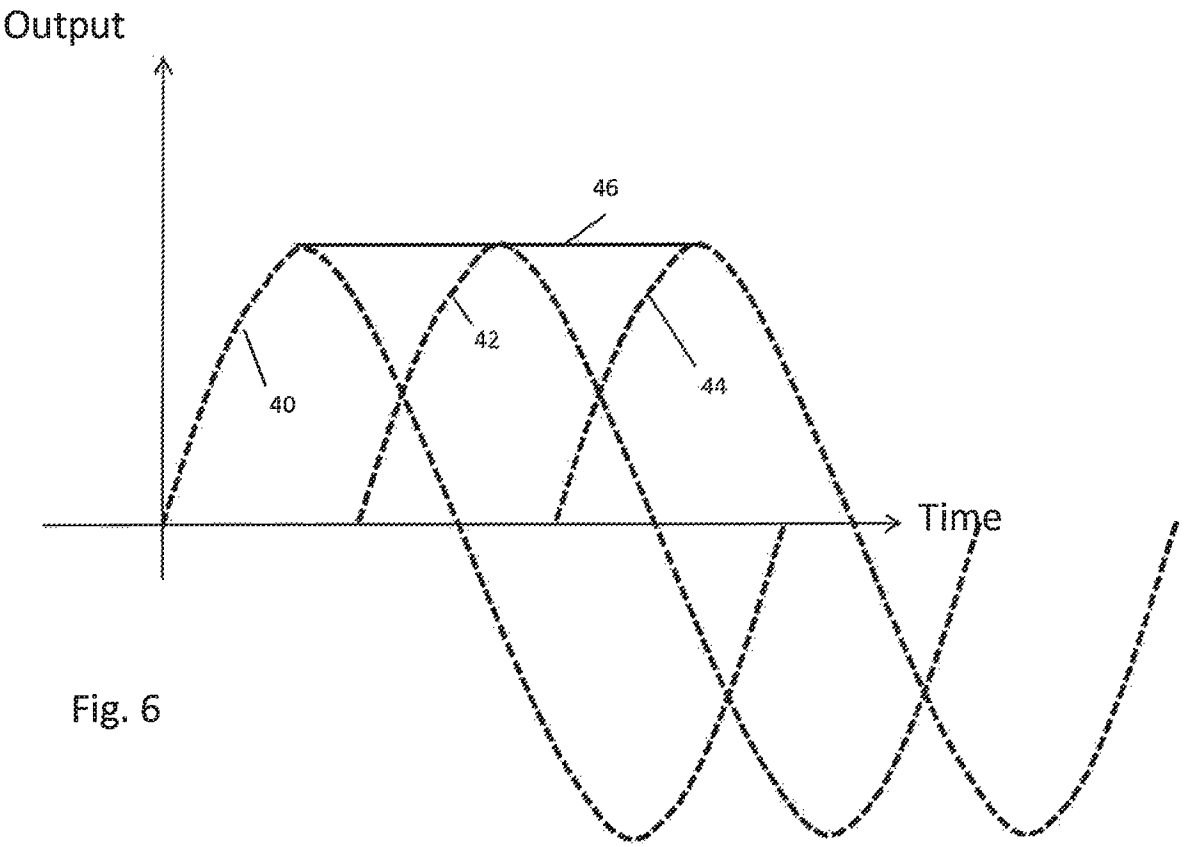
FIG. 6 is a plot of output versus time with respect to a group of piston cylinder devices of a fluid working machine comprising the cylinder block and crankshaft of FIGS. 1-5.

The cams 30-34 and the piston feet 24*a* slidably bear against one another such that, when the cams 30-34 drive or are driven by the pistons 24 reciprocating in the housing bores 12*a*, 12*b*, 12*c* of the first group 5, each of the pistons 24 reciprocates in respective housing bores to generate a sinusoidal output 40-44 (see FIG. 6). As the cams 30-34 drive or are driven by the pistons 24 at phases which are equally spaced, the sinusoidal outputs 40-44 of the piston cylinder devices of the first group combine to provide a substantially smooth output 46. It will be understood that the output 46 is high pressure fluid in the case of a pump (or a pump motor operating in pumping mode), and mechanical torque in the case of a motor (or a pump-motor operating in motoring mode).

Figure 7C:
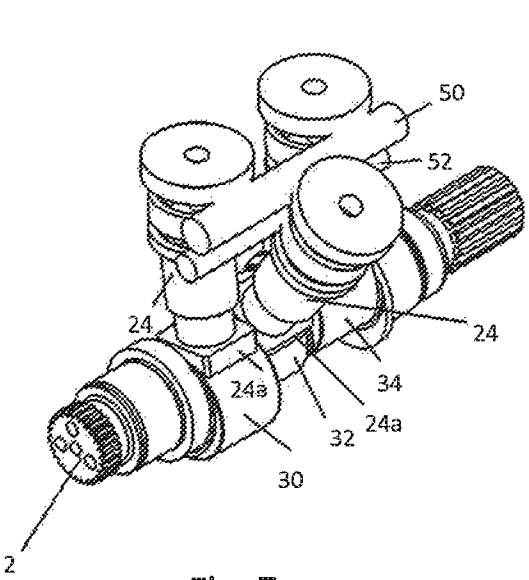
FIGS. 7*a*-7*c* are front, side and perspective views of the crankshaft, pistons and valve cylinder devices of a group of piston cylinder devices disposed about and extending away from the crankshaft of FIGS. 5*a*-5*d*, FIGS. 7*a*-7*c* also illustrating the common conduits fluidly connecting the low pressure valves within each group and the high pressure valves within each group respectively.
Figure 7B:
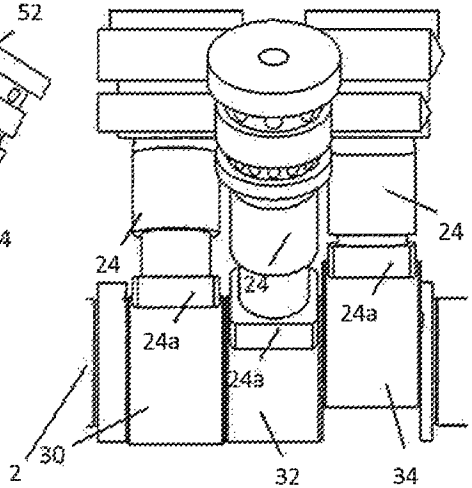
Figure 7A:
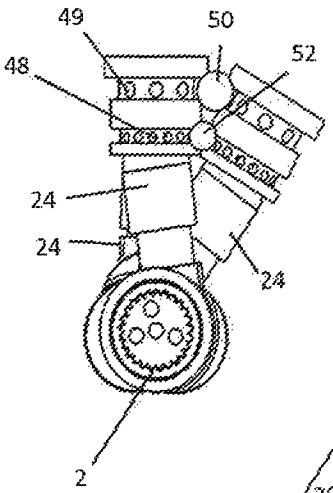

FIGS. 7*a*-7*c* are front, side and perspective views of the crankshaft, pistons and valve cylinder devices of a group of piston cylinder devices disposed about and extending away from the crankshaft of FIGS. 5*a*-5*d*. In the illustrated embodiment, the valve units 14 of the valve cylinder devices 13 comprise working fluid inlets 48 and working fluid outlets 49. The valve units 14 are annular valve units and the working fluid inlets 48 and outlets 49 are annular galleries provided around the perimeter of the valve units (it will be understood that the inlets and outlets may be interchangeable when the fluid working machine is a pump-motor operable to function as a pump and/or a motor in different operating modes and that, in this case, the inlet/outlet terminology assumes that the fluid working machine is a motor or a pump-motor operating in motoring mode). The low pressure valves of the integrated valve units 14 coupled to the housing bores 12*a*, 12*b* and 12*c* of the first group 5 are in fluid communication with each other by a first common conduit 50 which intersects the outlets 49. It will be understood that, in order for the first common conduit 50 to intersect the outlets 49, the first common conduit 50 typically intersects the housing bores 12*a*, 12*b*, 12*c* in which the valve cylinder devices 13 of the first group 5 are provided. In addition, the high pressure valves of the integrated valve units 14 coupled to the housing bores 12*a*, 12*b* and 12*c* of the first group 5 are in fluid communication with each other by a second common conduit 52 which intersects the inlets 48. It will be understood that, in order for the second common conduit 52 to intersect the inlets 48, the second common conduit 52 typically intersects the housing bores 12*a*, 12*b*, 12*c* in which the valve cylinder devices 13 of the first group 5 are provided.

The common conduits 50, 52 have longitudinal axes parallel to the axis of rotation 3 and are typically formed by single straight drillways extending through the cylinder block 1. The common conduit 50 extends between the low pressure valves of the piston cylinder devices of the first group 5, while the common conduit 52 extends between the high pressure valves of the piston cylinder devices of the first group. The longitudinal axes of the common conduits 50, 52 are offset from the first and third housing bores 12*a*, 12*c* of that group about the axis of rotation 3 in a first rotational sense (e.g. clockwise) and offset from the second housing bore 12*b* about the axis of rotation in a second rotational sense opposite the first rotational sense (e.g. anticlockwise) such that it has a circumferential position which is disposed circumferentially between the circumferential position of the second housing bore 12*b* and the circumferential positions of the first and third housing bores 12*a*, 12*c*. This is a space efficient arrangement which is made possible because the second housing bore 12*b* is axially offset from the first and/or third housing bores 12*a*, 12*c* and the second housing bore 12*b* is offset from the first and third housing bores 12*a*, 12*c* about the axis of rotation 3.

By fluidly connecting the low pressure valves and the high pressure valves via respective (single) common conduits, fewer conduits need to be formed within the cylinder block 1, and importantly each conduit can be drilled in a single operation and thus manufacture is faster and less expensive. In addition, as the cams 30-34 drive, or are driven by, the pistons reciprocating in the housing bores 12 of each group at different phases, the common conduits 50, 52 can have smaller diameters than might otherwise be the case because they do not have to have capacity for the combined peak flows from or to all of the piston cylinder devices of that group.

As the valve inlets and outlets are in the form of annular galleries, the orientation of the valve units 14 has little influence on the fluid communication of the valves with the common conduits 50, 52. However in alternative embodiments, the valve inlets/outlets may be directional (rather than annular galleries), for example the valve inlets and/or outlets may each comprise a single drilling (which may be perpendicular to the axis of rotation, for example). In this case, the valve units 14 need to be oriented and aligned with corresponding common conduits prior to securing in position, to ensure fluid communication therebetween.

It may be that the second housing bore 12*b* of one or more of the groups 5-10 is canted with respect to the first and third housing bores 12*a*, 12*c* of that group such that the longitudinal axis of the second housing bore 12*b* (along which the piston reciprocating within the second housing bore 12*b* reciprocates) intersects with the longitudinal axis of the first and/or third housing bores 12*a*, 12*c* (along which the respective pistons reciprocate in the respective first and/or third housing bores) at the axis of rotation 3 when viewed along the axis of rotation. However, in some cases, the second housing bore 12*b* of one or more groups 5-10 may be canted with respect to the first and third housing bores 12*a*, 12*c* of that group such that the longitudinal axis of the second housing bore 12*b* intersects with the longitudinal axis of the first and/or third housing bores 12*a*, 12*c* at a point above the axis of rotation 3 (i.e. closer to the second 12*b* and first and/or third housing bores 12*a*, 12*c* than the axis of rotation 3 is to the second 12*b* and first and/or third housing bores 12*a*, 12*c*) when viewed along the axis of rotation. This allows more space to be provided for the common conduits 50, 52.

The piston cylinder devices of each group 5-10 provide a number discrete service outputs, typically one per group. Accordingly, the common conduits 50, 52 typically extend to respective ports (not shown) provided at an end-plate (not shown) bolted to the front axial face 62 of the cylinder block 1. More specifically, one of the common conduits 50, 52 (which one depends on whether the fluid working machine is a pump, a motor or a pump motor operating in pumping or motoring mode) is connected to a source of fluid: a propel return, a common crankcase/tank or any other fluid source, while the other common conduit 50, 52 (again which one depends on whether the fluid working machine is a pump, a motor or a pump motor operating in pumping or motoring mode) is connected to a sink of fluid: propel out, work function out, universal out or any other fluid sink.

It may be that more or less than three valve cylinder devices are provided in each group 5-10. It may be that there are more or fewer than four groups. In some embodiments, the second housing bore 12*b* of each group is offset from the first and third housing bores 12*a*, 12*c* of that group by an angle of $(360/(m*n))^\circ$ about the axis of rotation, where m is the number of groups and n is the number of housing bores per group (or, if different groups have different numbers of housing bores per group, it may be that n is the number of housing bores in the group with the greatest number of housing bores). In addition, to ensure that the pistons 24 of each group drive or are driven by the cams 30-34 at phases which are substantially equally spaced, the first and third cams 30, 34 may be offset from each other by an angle of $2*(360/(n))^\circ$ in a first rotational sense (e.g. clockwise) and the second cam 32 may be offset from the first cam 30 in the said first rotational sense about the axis of rotation by an angle of $((360/(n))-\alpha)^\circ$ where $\alpha$ is the angle in degrees by which the second housing bore 12*b* is offset from the first and third housing bores 12*a*, 12*c* about the axis of rotation 3.

The fluid working machine described above may be manufactured as follows. The cylinder block 2 is typically formed by casting or machining a central axial bore 4 through the centre of a monolithic billet of material, and the housing bores 12*a*-12*c* of each group are typically formed in the cylinder block 2 by drilling bores substantially radially through the billet with respect to the central axial bore 4, the bores being disposed about and extending outwards with respect to the axial bore 4. The housing bores 12*a*-12*c* may alternatively be cast in the billet with the central axial bore 4 before being subsequently drilled. As explained above, the first and third housing bores 12*a*, 12*c* of each group are axially offset from each other, and the second housing bore 12*b* is axially offset from the first and third housing bores 12*a*, 12*c* and the second housing bore 12*b* is offset from the first and third housing bores 12*a*, 12*c* about the central axial bore 4. The groups 5-10 of housing bores are spaced from each other about the central axial bore 4. In addition, the housing bores 12*a*-12*c* of each group are provided with a space-efficient nesting arrangement whereby the second housing bore has an axial extent which overlaps at least partly with axial extent of one, or the axial extents of both, of the first and third housing bores 12*a*, 12*c*.

The common conduits 50, 52 are formed by drilling straight drillways through the cylinder block 2 between the housing bores 12*a*-12*c* of each group which extend parallel to the axial bore 4. A thread cutting tool is used to add the thread to the outer ends of the housing bores for mating with the corresponding thread on the integrated valve units 14. As described above, the longitudinal axes of the common conduits 50, 52 of each group are offset from the first and third housing bores 12*a*, 12*c* of that group about the axis of rotation 3 in a first rotational sense (e.g. clockwise) and offset from the second housing bore 12*b* of that group about the axis of rotation in a second rotational sense opposite the first rotational sense (e.g. anticlockwise) such that it is disposed circumferentially between the second housing bore 12*b* and the first and third valve housing bores 12*a*, 12*c*.

Integrated valve units 14 are screwed into the respective housing bores 12*a*-12*c* of each group. Pistons 24 may be mounted to con-rods (which act as piston feet) coupled to (or resting on) the cams 30-34 of the crankshaft 2 such that the pistons 24 are in driving relationship with the cams 30-34, the crankshaft 2 is mounted in the axial bore 4 and the pistons 24 are reciprocably received by the housing bores 12*a*-12*c* of the respective groups 5-10. As explained above, the cams 30-34 of the crankshaft 2 are arranged (typically unevenly offset about the axis of rotation 3) such that they drive or are driven by the pistons 24 within each group at phases which are substantially equally spaced.

It will be understood that, in some embodiments, the third housing bore 12*c* and associated valve cylinder device 13 and piston 24 may be omitted from each group 5-10. However, the third housing bore 12*c* and associated valve cylinder device 13 and piston 24 are preferably included in order to provide a substantially smooth output from each group 5-10.

Further variations and modifications may be made within the scope of the invention herein described.

Additional information, in particular additional features, embodiments and advantages of the present invention can be found in application PCT/EP2014/060896 that was filed at the European patent office as receiving office for a PCT-application on the very same date by the same applicants. The disclosure of said application is considered to be fully contained and incorporated in the present application by reference.

What is claimed is:

1. A fluid working machine comprising:

a crankshaft which is rotatable about an axis of rotation;

adjacent first and second groups of valve cylinder devices spaced from each other about the axis of rotation;

wherein each of the first and second groups of valve cylinder devices having first, second and third valve cylinder devices arranged about and extending outwards with respect to the crankshaft;

wherein the first and third valve cylinder devices are axially offset from each other;

wherein each second valve cylinder device is axially offset from the first and third valve cylinder devices and each second valve cylinder device is offset from the first and third valve cylinder devices about the axis of rotation;

wherein each second valve cylinder device has an axial extent which overlaps with the axial extent of one, or the axial extents of both, of the first and third valve cylinder devices;

wherein the first valve cylinder device of the first group of valve cylinder devices and the first valve cylinder device of the second group of valve cylinder devices are provided on a first plane such that at least 50% of the axial extent of the first valve cylinder devices overlap;

wherein the second valve cylinder device of the first group of valve cylinder devices and the second valve cylinder device of the second group of valve cylinder devices are provided on a second plane such that at least 50% of the axial extent of the second valve cylinder devices overlap;

wherein the third valve cylinder device of the first group of valve cylinder devices and the third valve cylinder device of the second group of valve cylinder devices are provided on a third plane such that at least 50% of the axial extent of the third valve cylinder devices overlap; and wherein the first plane, the second plane and the third plane are substantially perpendicular to the axis of rotation.

2. The fluid working machine of claim 1 wherein, within the said one or each of the first and second groups of valve cylinder devices, the first and third valve cylinder devices are axially aligned with each other such that the first and third valve cylinder devices are axially aligned with an alignment axis extending between the center points of the first and third valve cylinder devices, the alignment axis being substantially parallel with the axis of rotation.

3. The fluid working machine of claim 2 further comprising respective pistons reciprocating in the first, second and third valve cylinder devices of the said one or each of the first and second groups of valve cylinder devices, wherein the crankshaft comprises first, second and third cams, and wherein, within the said one or each of the first and second groups of valve cylinder devices, the piston reciprocating in the first valve cylinder device is in driving relationship with the first cam, the piston reciprocating in the second valve cylinder device is in driving relationship with the second cam and the piston reciprocating in the third valve cylinder device is in driving relationship with the third cam.

4. The fluid working machine according to claim 2, wherein the valve cylinder devices of the first and second groups of valve cylinder devices are provided in respective housing bores arranged about and extending outwards with respect to the axial bore.

5. The fluid working machine of claim 2, wherein the said valve cylinder devices of the said first and second groups of valve cylinder devices each comprise a first working fluid port and a second working fluid port wherein, within the first and/or second groups of valve cylinder devices, the first working fluid ports of the valve cylinder devices are fluidly connected and/or the second working fluid ports of the valve cylinder devices are fluidly connected.

6. The fluid working machine of claim 1 further comprising respective pistons reciprocating in the first, second and third valve cylinder devices of each of the first and second groups of valve cylinder devices, wherein the crankshaft comprises first, second and third cams, and wherein, within each of the first and second groups of valve cylinder devices, the piston reciprocating in the first valve cylinder device is in driving relationship with the first cam, the piston reciprocating in the second valve cylinder device is in driving relationship with the second cam and the piston reciprocating in the third valve cylinder device is in driving relationship with the third cam.

7. The fluid working machine according to claim 6 wherein the first, second and third cams are rotationally offset from each other about the axis of rotation such that the pistons reciprocating in the first, second and third valve cylinder devices of the said one or each of the first and second groups of valve cylinder devices drive, or are driven by, the first, second and third cams at phases which are substantially equally spaced.

8. The fluid working machine according to claim 7, wherein the valve cylinder devices of the first and second groups of valve cylinder devices are provided in respective housing bores arranged about and extending outwards with respect to the axial bore.

9. The fluid working machine according to claim 6, wherein the valve cylinder devices of the first and second groups of valve cylinder devices are provided in respective housing bores arranged about and extending outwards with respect to the axial bore.

10. The fluid working machine according to claim 1, wherein the valve cylinder devices of the first and second groups of valve cylinder devices are provided in respective housing bores arranged about and extending outwards with respect to the axial bore.

11. The fluid working machine according to claim 10 wherein the first, second and third valve cylinder devices of the said one or each of the first and second groups of valve cylinder devices are provided in respective first, second and third housing bores, the first and third housing bores being axially offset from each other, the second housing bore being axially offset from the first and third housing bores and the second housing bore being offset from the first and third housing bores about the axis of rotation, wherein the second housing bore has an axial extent which overlaps with the axial extent of one, or the axial extents of both, of the first and third housing bores.

12. The fluid working machine of claim 1, wherein the said valve cylinder devices of the said first and second groups of valve cylinder devices each comprise a first working fluid port and a second working fluid port wherein, within the first and/or second groups of valve cylinder devices, the first working fluid ports of the valve cylinder devices are fluidly connected and/or the second working fluid ports of the valve cylinder devices are fluidly connected.

13. The fluid working machine according to claim 1, wherein the first, second and third valve cylinder devices of the said one or each of the first and second groups of valve cylinder devices each have a first valve comprising a first working fluid port, the respective first working fluid ports of the valve cylinder devices, within the said one or each of the first and second groups of valve cylinder devices, being in fluid communication with each other via a respective common conduit.

14. The fluid working machine according to claim 13 wherein the common conduit of the said one or each of the first and second groups of valve cylinder devices has a longitudinal axis substantially parallel to the axis of rotation.

15. The fluid working machine according to claim 13 wherein, within the said one or each of the first and second groups of valve cylinder devices, the common conduit comprises a single straight drillway extending through the cylinder block in a direction substantially parallel to the axis of rotation.

16. The fluid working machine according to claim 13 wherein, within the said one or each of the first and second groups of valve cylinder devices, a longitudinal axis of the common conduit is offset from the first and third valve cylinder devices about the axis of rotation in a first rotational sense and offset from the second valve cylinder device about the axis of rotation in a second rotational sense opposite the first rotational sense such that the common conduit has a circumferential position which is disposed circumferentially between the circumferential position of the second valve cylinder device and the circumferential positions of the first and third valve cylinder devices.

17. The fluid working machine of claim 1, wherein at least 90% of the axial extent of the first valve cylinder devices overlap, wherein at least 90% of the axial extent of the second valve cylinder devices overlap, and wherein at least 90% of the axial extent of the third valve cylinder devices overlap.

18. The fluid working machine of claim 17, wherein 100% of the axial extent of the first valve cylinder devices overlap, wherein 100% of the axial extent of the second valve cylinder devices overlap, and wherein 100% of the axial extent of the third valve cylinder devices overlap.

19. The fluid working machine of claim 1, wherein the first and second groups of valve cylinder devices are provided in a cylinder block.

* * * * *